US008469078B2

(12) United States Patent
Drew

(10) Patent No.: US 8,469,078 B2
(45) Date of Patent: Jun. 25, 2013

(54) RETRACTABLE COVERING FOR DOORWAYS, ARCHWAYS, AND THE LIKE

(75) Inventor: Terrence M. Drew, Superior, CO (US)

(73) Assignee: Hunter Douglas Inc., Pearl River, NJ (US)

( * ) Notice: Subject to any disclaimer, the term of this patent is extended or adjusted under 35 U.S.C. 154(b) by 0 days.

(21) Appl. No.: 13/206,883

(22) Filed: Aug. 10, 2011

(65) Prior Publication Data

US 2012/0043033 A1 Feb. 23, 2012

Related U.S. Application Data

(60) Provisional application No. 61/374,716, filed on Aug. 18, 2010.

(51) Int. Cl.
*E05D 15/06* (2006.01)

(52) U.S. Cl.
USPC ..... 160/196.1; 160/84.06; 160/212; 160/330; 16/87.4 R; 16/95 R

(58) Field of Classification Search
USPC ..... 160/196.1, 84.06, 212, 210, 345, 160/330; 16/87.4 R, 90, 92, 103; 104/103, 104/94; 49/154, 155, 223, 222, 260
See application file for complete search history.

(56) References Cited

U.S. PATENT DOCUMENTS

| | | | | |
|---|---|---|---|---|
| 2,761,150 | A * | 9/1956 | Kellogg | 4/558 |
| 3,403,767 | A * | 10/1968 | Gerisch | 198/360 |
| 3,793,673 | A * | 2/1974 | Lawrence, Jr. | 16/97 |
| 4,915,153 | A * | 4/1990 | Toti | 160/84.04 |
| 6,601,637 | B2 * | 8/2003 | Toti | 160/199 |
| 6,766,847 | B1 * | 7/2004 | Wang | 160/199 |
| 7,891,398 | B2 * | 2/2011 | Chino et al. | 160/84.06 |
| 7,942,184 | B2 * | 5/2011 | Cech et al. | 160/84.05 |
| 8,046,872 | B2 * | 11/2011 | Burgess et al. | 16/97 |
| 2012/0043033 | A1 * | 2/2012 | Drew | 160/341 |

* cited by examiner

*Primary Examiner* — Blair M. Johnson
(74) *Attorney, Agent, or Firm* — Dorsey & Whitney LLP

(57) ABSTRACT

A horizontally retractable covering for an architectural opening includes a headrail supporting a collapsible panel of material, a fixed rail securable to a side of the architectural opening and to a side edge of the panel, and a movable rail secured to the opposite side of the panel while being movable along the length of the headrail. An improved trolley connecting the top end of the movable rail to the headrail is provided so as to permit uniform gathering of the panel material along the horizontal extent of the trolley for improved aesthetics when the panel is fully extended across the architectural opening. A stabilizing cord system maintains a parallel relationship of the movable rail to the fixed rail to assure desired movement of the movable rail while permitting the aforenoted uniform gathering of the panel material.

14 Claims, 20 Drawing Sheets

RETRACTABLE COVERING FOR DOORWAYS, ARCHWAYS, AND THE LIKE

CROSS REFERENCE TO RELATED APPLICATION

This application claims the benefit under 35 U.S.C. §119 (e) to U.S. provisional application No. 61/374,716, entitled "Retractable Covering for Doorways, Archways, and the Like" filed on Aug. 18, 2010, which is hereby incorporated herein by reference in its entirety.

BACKGROUND OF THE INVENTION

1. Field of the Invention

The present invention relates generally to retractable coverings for use in architectural openings such as doorways, archways, or the like, wherein the covering includes a horizontal headrail mountable across the top of the opening from which is suspended a horizontally retractable, vertically extending, collapsible panel of shade material. The shade material has a fixed vertical side edge secured to a fixed vertical rail and a movable vertical side edge secured to a movable vertical rail. The covering can be a side draw or a center draw covering with the side-draw covering have the fixed rail along one side of the opening and the movable rail extendable to the opposite side of the opening. In a center-draw system, there are two panels with each having its fixed side rail at one side of the opening and its movable rail extendable to a longitudinal center of the headrail.

A trolley is secured to the top edge of the movable rail and has an elongated horizontal leg supported on longitudinally extending tracks within the headrail and reciprocally movable along the tracks. The trolley further has a vertical leg that extends into the open upper end of the movable rail and is secured thereto so that movement of the movable vertical rail causes the trolley to travel along the length of the headrail. The trolley is designed so that the shade material can extend uniformally along the horizontal leg of the trolley, and a stabilizing cord system interconnects the fixed rail with the movable rail at vertically spaced locations to maintain a parallel relationship between the movable rail and the fixed rail. The vertical orientation of the movable rail in turn maintains a horizontal orientation of the horizontal leg of the trolley to facilitate a desired interconnection of the trolley with the shade material.

2. Description of the Relevant Art

Retractable coverings for architectural openings, such as windows, doorways, archways, and the like, have taken numerous forms for many years. Some such coverings are in the form of horizontally collapsible panels suspended from a headrail and having one edge connected to a fixed vertical rail and the opposite edge to a movable vertical rail. A trolley is secured to the top of the movable vertical rail and has a horizontal arm supported by and movable along the length of the headrail. The horizontal arm is typically six or so inches in length and includes two pair of horizontally disposed rollers which are disposed at opposite ends of the horizontal arm for rolling movement along the headrail. A problem with prior art retractable panels resides in the fact that the panel itself is suspended from the headrail by a plurality of carriers which are also movable along the length of the headrail and supported on a common track with the trolley. Accordingly, the carriers interfere with the trolley at the connection of the retractable panel to the trolley, and as a result, an aesthetic interruption in the panel occurs.

The present invention has been developed to provide a new and improved system for connecting a retractable vertical panel to a trolley and a headrail along which the trolley can translate without detracting from the aesthetics of the panel.

SUMMARY OF THE INVENTION

The present invention is an improved retractable panel for selectively covering an architectural opening, such as a doorway, window, archway, or the like, where the covering includes a headrail and a vertically-extending, collapsible panel suspended from the headrail having a first vertical edge secured to a fixed vertical rail, and an opposite movable vertical edge secured to a movable vertical rail.

A generally L-shaped trolley has a vertical leg secured in the open upper end of the movable vertical rail of the covering, and a horizontal leg supported on tracks within the headrail and movable along the length of the headrail to move the covering between extended and retracted positions. The proximal end of the horizontal leg of the trolley is aligned with the vertical leg and has a pair of horizontally spaced rollers adapted to roll along tracks defined in the headrail. The opposite or distal end of the horizontal leg has a single roller guided within a track in a top wall of the headrail. The single roller is maintained in rolling engagement with the headrail through the vertical orientation of the movable vertical rail.

A stabilizing cord system maintains a parallel relationship between the fixed vertical rail and the movable vertical rail, and since the fixed vertical rail is fixed in a vertical orientation, the movable vertical rail remains vertically oriented regardless of its horizontal displacement from the fixed vertical rail as when the covering is moved between extended and retracted conditions. The stabilizing cord system includes a plurality of elongated non-extensible cords, each of a fixed length. Each cord has a first end anchored to the end of the headrail opposite the fixed vertical rail and extends from that end toward the movable rail where it slidably passes across a transverse pin in the trolley and extends downwardly into the movable vertical rail. At different locations along the vertical height or extent of the movable vertical rail, each cord slidably passes around a transverse pin in the movable vertical rail and extends horizontally through the panel to the fixed vertical rail where each cord is adjustably anchored.

In this manner, as the movable vertical rail is manually manipulated so as to roll along the length of the headrail, each control cord maintains a fixed spacing of the movable vertical rail from the fixed vertical rail so as to maintain a vertical orientation of the movable vertical rail at any position between fully retracted and fully extended.

Inasmuch as the trolley has horizontal and vertical legs perpendicular to each other and the movable vertical rail is always maintained vertically, the horizontal leg of the trolley always remains horizontal. The sole roller at the distal end of the horizontal leg thereby remains in rolling engagement with the undersurface of the top of the headrail.

The collapsible panel is suspended by a plurality of carriers slidable or rollable along the headrail so that as the panel is moved reversibly between a retracted position where the movable vertical rail is closely adjacent to the fixed vertical rail with the collapsible panel stacked or collapsed therebetween and an extended position where the movable vertical rail is moved away from the fixed vertical rail, the carriers slide or roll along a common track in the headrail with the pair of horizontally displaced rollers on the trolley. There is no interference, however, between the track on which the carriers are supported and the sole roller at the distal end of the horizontal leg of the trolley so that the carriers can extend fully and non-interruptedly from the fixed vertical rail of the covering to the movable vertical rail. The carriers for the covering are thereby desirably spaced across the full width of the panel providing a desired aesthetic for the panel.

Other aspects, features and details of the present invention can be more completely understood by reference to the following detailed description of a preferred embodiment, taken in conjunction with the drawings and from the appended claims.

DETAILED DESCRIPTION OF THE INVENTION

Figure 1A:
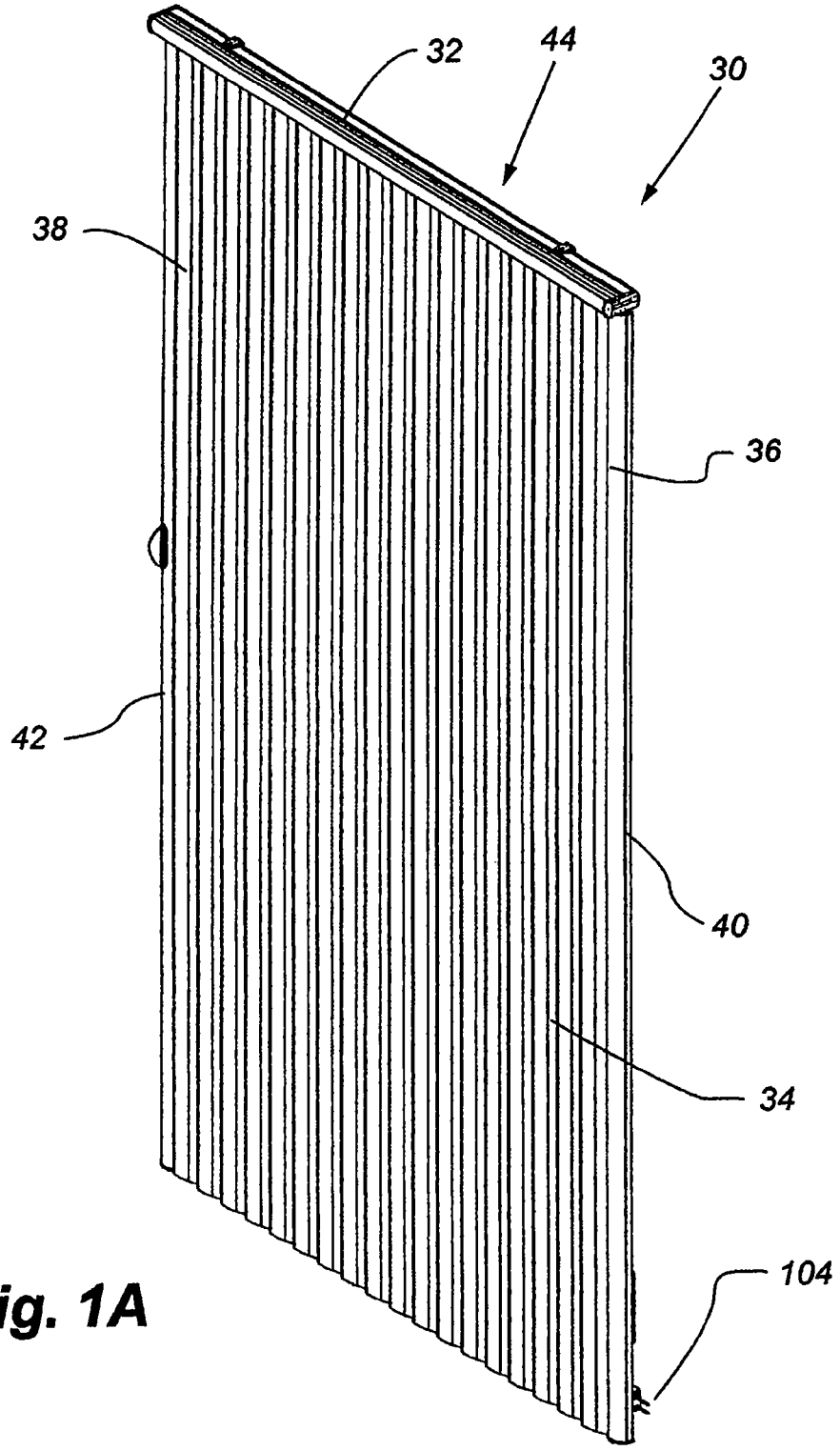
FIG. 1A is an isometric of a side-draw embodiment of the present invention with the covering in a fully-extended position.

The retractable covering 30 of the present invention finds a primary use for covering an architectural opening, such as a doorway, archway, window or the like. The covering is movable between extended and retracted positions and includes a headrail 32 mounted in the architectural opening across a top frame member (not shown) thereof, which supports a vertically-extending, horizontally collapsible shade panel 34 having one vertical edge 36 which is fixed and the other vertical edge 38 which is horizontally movable. The fixed edge and the movable edge of the collapsible panel have a fixed rail 40 and a movable rail 42 (not shown), respectively, with the fixed rail being securable to a vertical side frame member of an architectural opening so that the movable rail can be extended away therefrom while remaining parallel to the fixed rail.

Such a covering 30 can be used as a side-draw system 44 wherein the movable rail 42 is horizontally movable from one side of the architectural opening to the opposite side of the architectural opening, or can be used as a center-draw system 46 where the movable rail is movable from a retracted position adjacent to the fixed rail 40 to an extended position at approximately the midpoint of the headrail from which the collapsible panel 34 is suspended. In the later application, there would be two identical but mirror image coverings, each having a fixed rail secured to a side of the architectural opening, and a movable rail that is moved to the center of the opening in the extended condition of the covering.

Figure 1B:
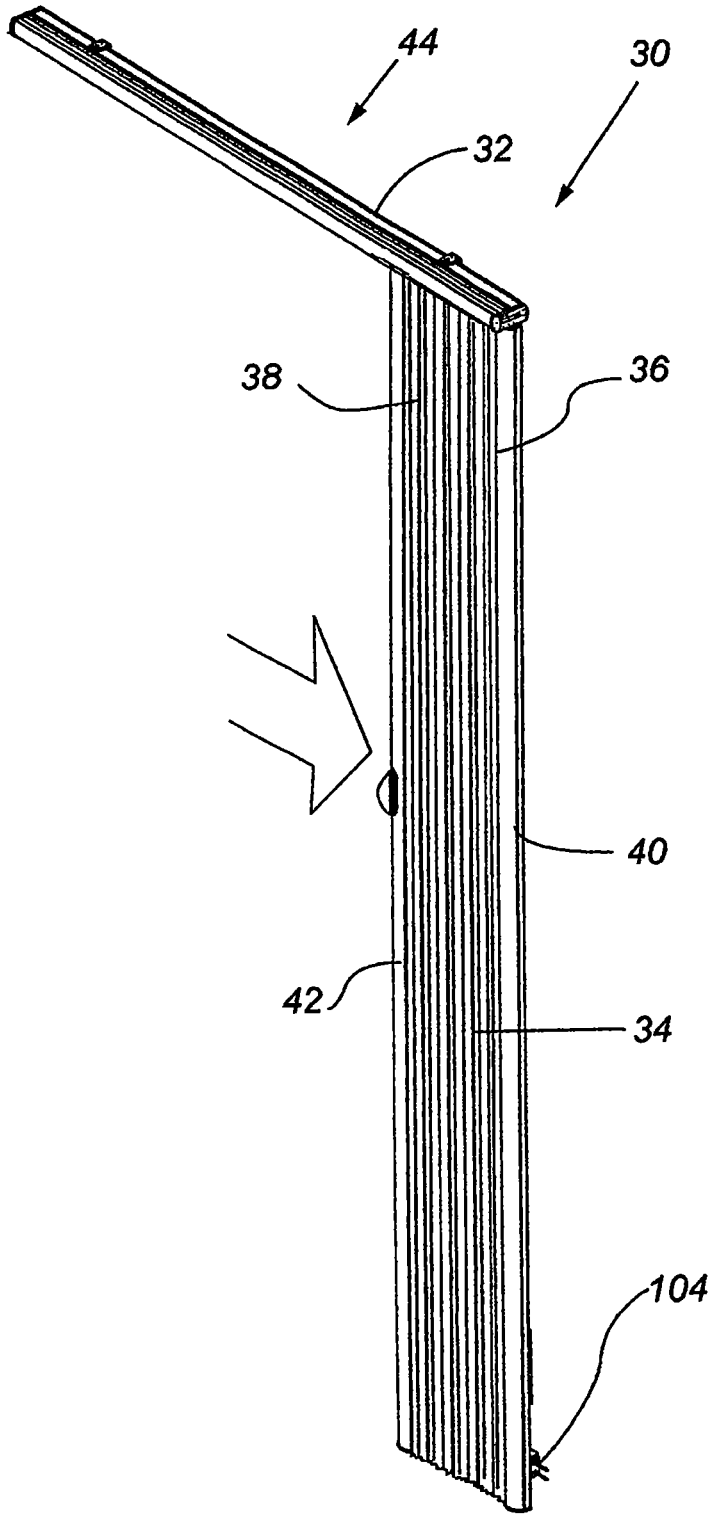
FIG. 1B is an isometric showing the covering of FIG. 1A in a fully-retracted position.
Figure 2A:
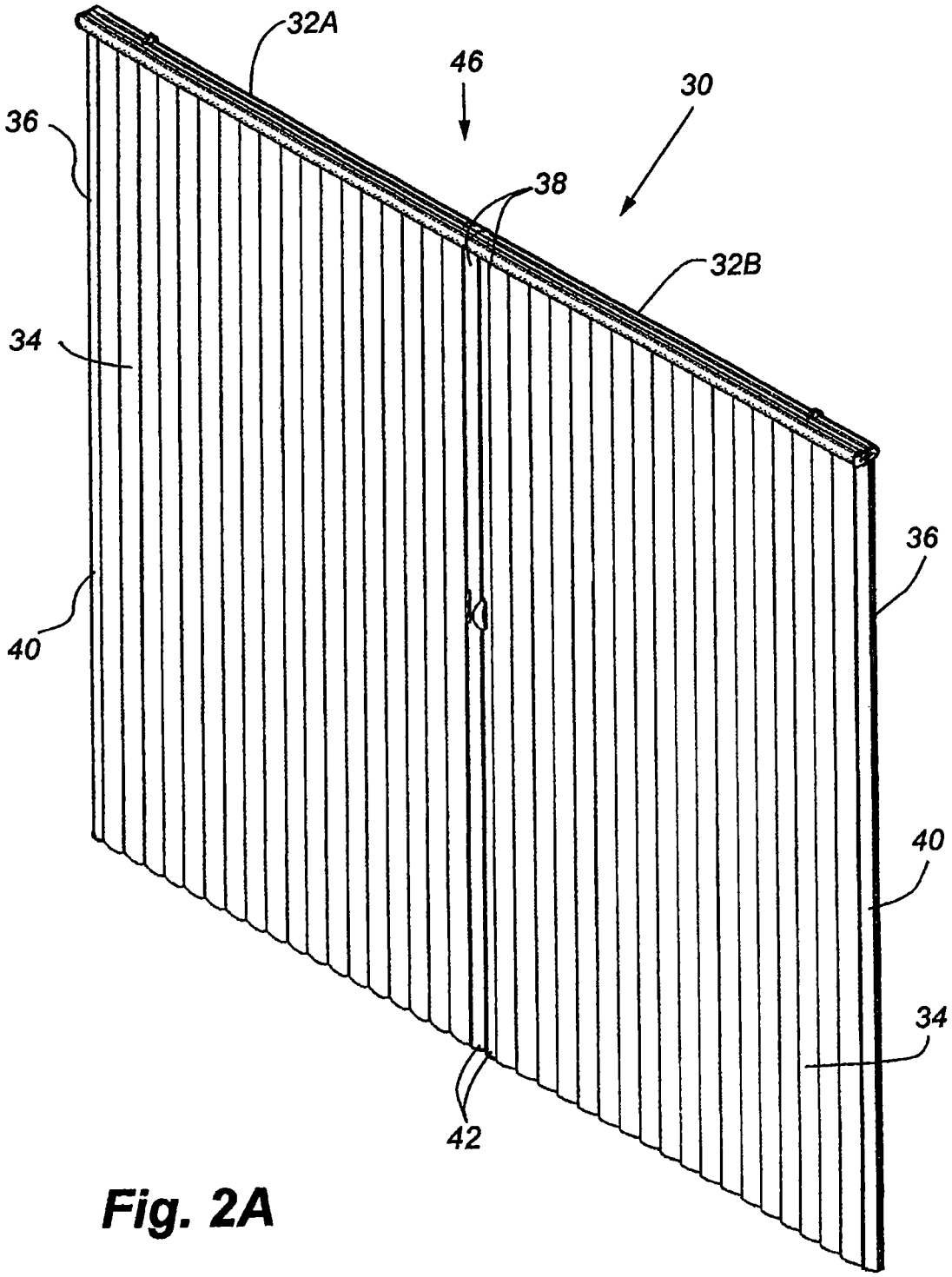
FIG. 2A is an isometric of a center-draw system in accordance with the present invention where two separate panels are anchored along their outer side edges to the vertical sides of the architectural opening and have a movable edge fully extended so as to confront the movable edge of the opposite panel at the longitudinal center of the headrail.
Figure 2B:
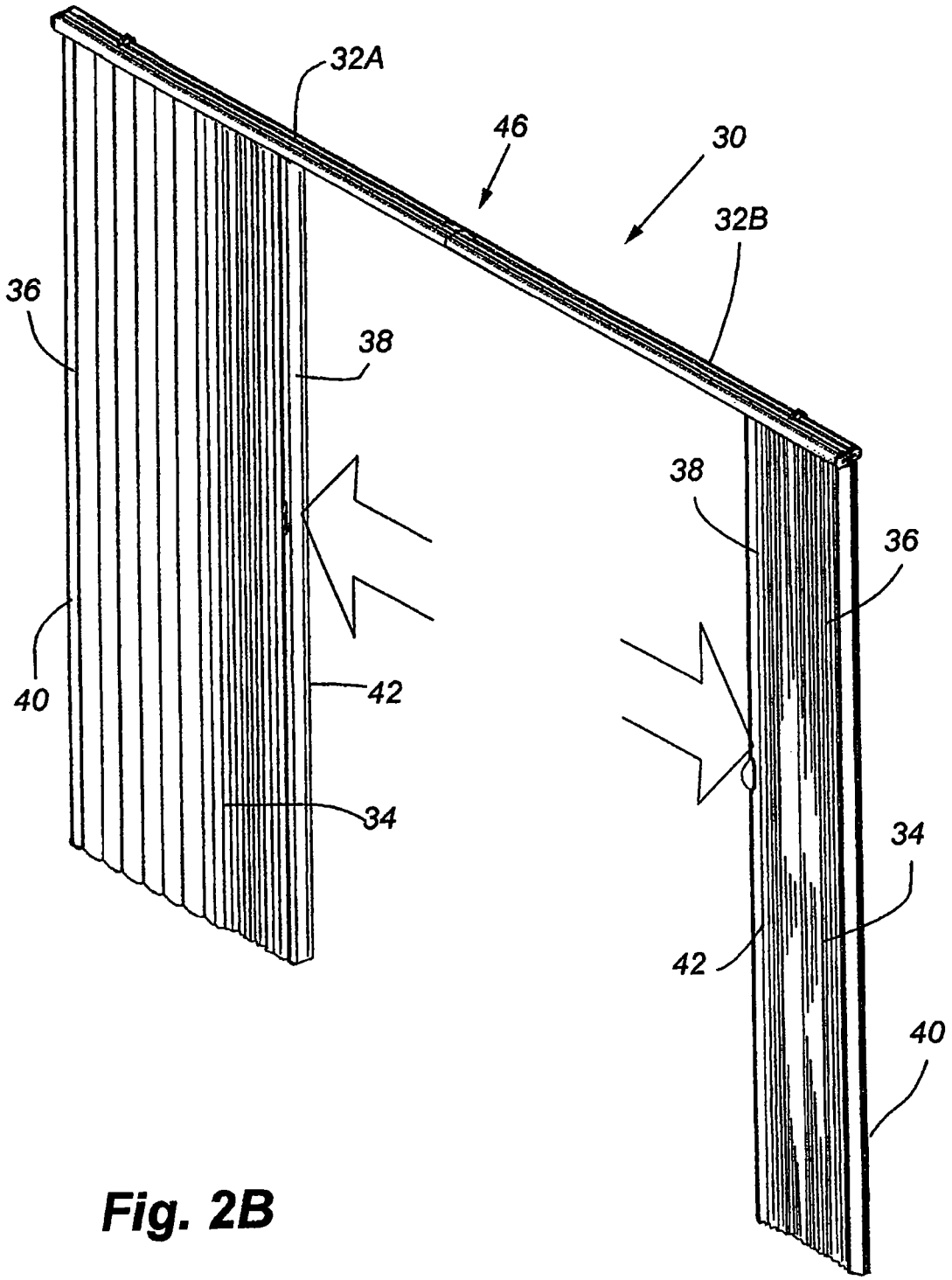
FIG. 2B is an isometric similar to FIG. 2A showing one panel fully retracted and the other panel partially retracted.

FIGS. 1A and 1B illustrate a side-draw system 44 showing the covering 30 fully extended in FIG. 1A and fully retracted in FIG. 1B. FIGS. 2A and 2B show a center-draw system 46 with FIG. 2A showing both panels 34 of the system fully extended so that the movable rails 42 are contiguous with each other at the center of the architectural opening, and FIG. 2B showing the right panel fully retracted and the left panel partially retracted.

Figure 3:
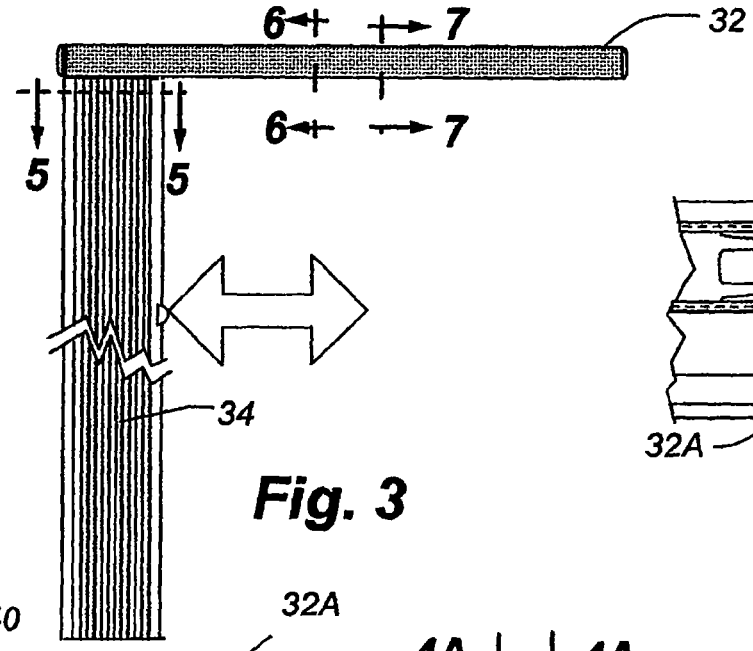
FIG. 3 is a front diagrammatic elevation of a side-draw system of the type shown in FIGS. 1A and 1B with the panel fully retracted and the fixed edge of the panel being along the left side of the covering.

While the collapsible panel 34 itself could assume numerous forms, for purposes of the present disclosure, it is illustrated as a vertically suspended panel having a back sheet 48 and a front sheet 50 (FIGS. 5, 17 and 18) with the front sheet being secured to the back sheet along horizontally spaced vertical lines of connection to form a plurality of vertically-extending loops 52. When the back sheet is fully extended, it assumes a flat, planar configuration (FIGS. 17 and 18) while the front sheet has the plurality of vertically-extending loops extending forwardly from the back sheet, and when the panel is fully retracted, as shown for example in FIGS. 3, 4 and 5, the back sheet can be seen to be gathered rearwardly relative to the front sheet so as to form a plurality of rearwardly-projecting, vertically-extending loops 54 which are more shallow than the loops on the front sheet extending forwardly from the back sheet. In summary, when a panel is fully extended, as shown for example in FIG. 1A or 2A, the back sheet forms a flat planar albeit flexible sheet of material, while the front sheet always forms a plurality of vertically-extending loops that extend forwardly from the back sheet regardless of whether or not the panel is extended or retracted.

Figure 7A:
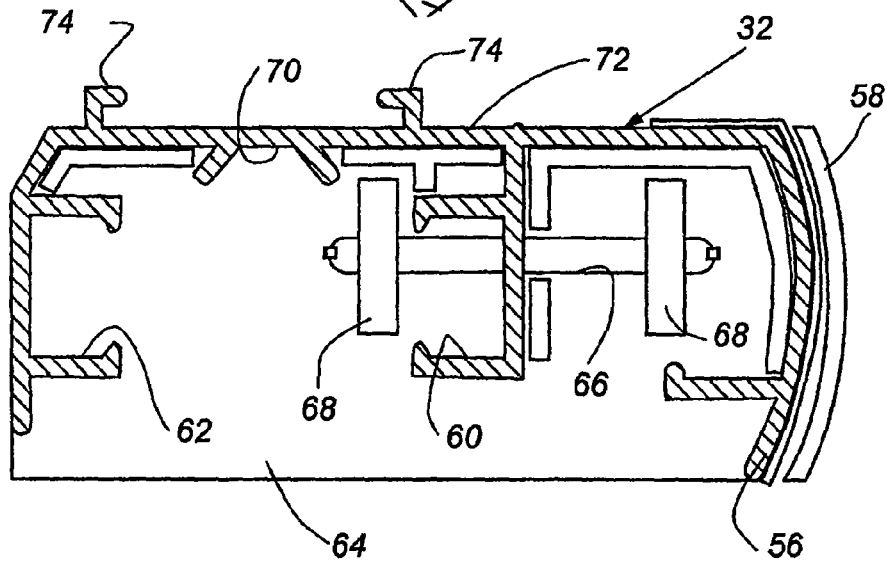
FIG. 7A is an enlarged section taken along line 7A-7A of FIG. 3.
Figure 7:
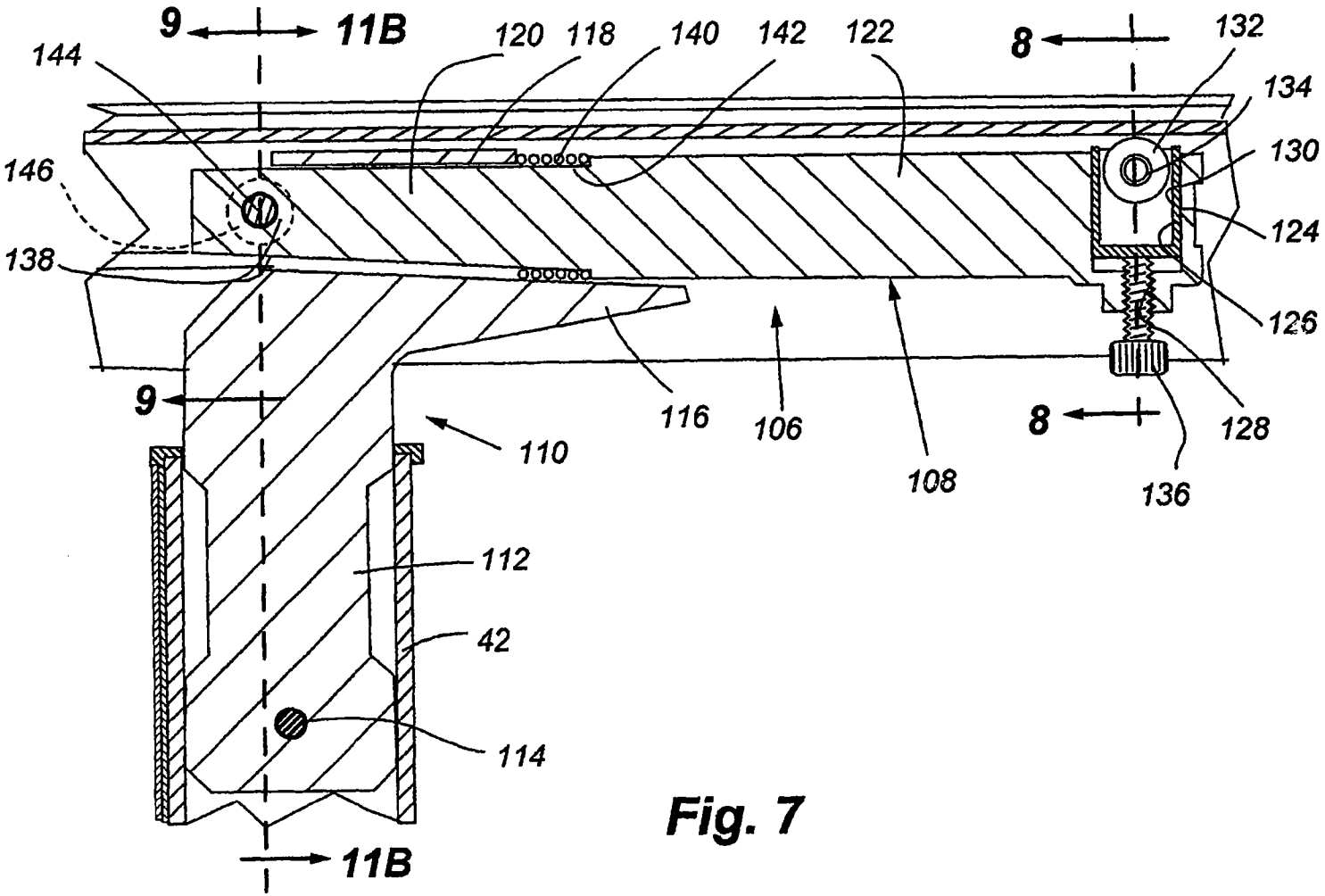
FIG. 7 is a fragmentary section taken along line 7-7 of FIG. 6.

The headrail 32 (FIGS. 7,8 and 9) in the side-draw system 44 is a one-piece, extruded, downwardly-opening, channel-shaped member made of aluminum or other rigid and preferably lightweight material. The headrail has an arcuate front wall 56 which can be covered with a decorative fabric 58 similar or identical to the fabric from which the front sheet 50 of the collapsible or retractable panel 34 is made. The headrail further has inner 60 and an outer 62 spaced confronting side tracks extending longitudinally thereof for a purpose to be described hereafter. End caps 64 (FIGS. 7,17 and 18) are also removably secured in the opposite open ends of the headrail with the end caps having a horizontal slot 66, as seen in FIG. 7A, aligned with a pair of parallel, vertically-extending ribs 68 to which stabilizing cords can be connected as will be described hereafter. A third track 70 identified as an upper track is formed on the underside of the top wall 72 of the headrail with the third track being centered above and between the opposing side tracks 60 and 62. The top surface of the top wall of the headrail has a pair of inverted L-shaped ribs 74 which define an open channel used for securing the headrail to a mounting bracket which is not shown.

Figure 4A:
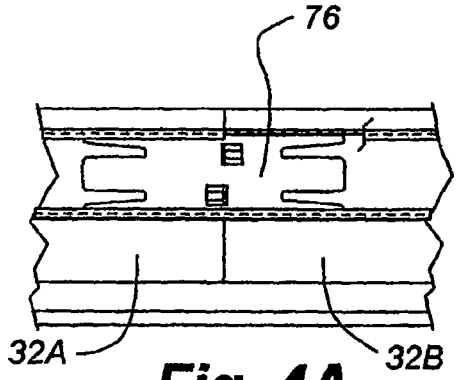
FIG. 4A is an enlarged fragmentary view taken along line 4A-4A of FIG. 4.
Figure 4:
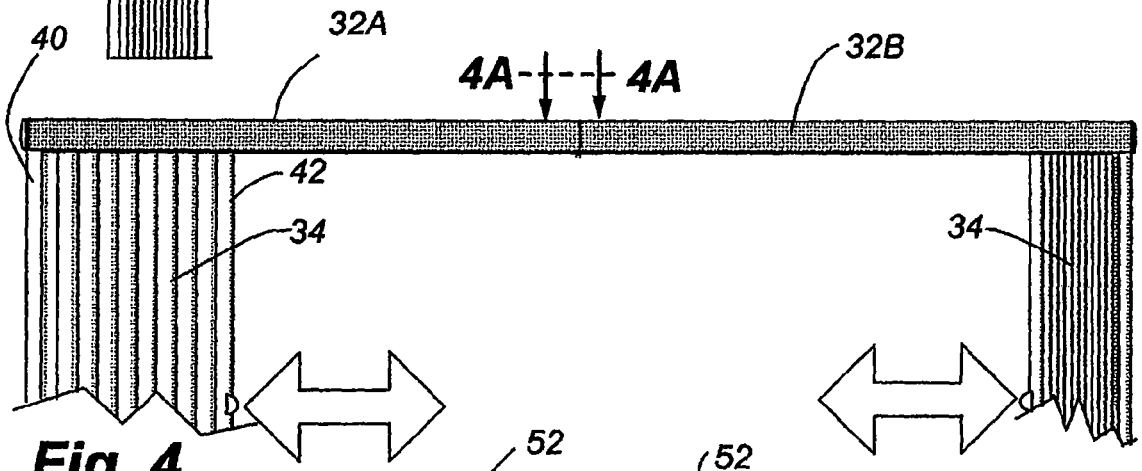
FIG. 4 is a fragmentary diagrammatic front elevation similar to FIG. 3 of a center-draw system as shown in FIG. 2B.

In the center-draw system 46, there are two headrail parts 32A and 32B identical to the headrail 32 as described which are axially aligned and abutted as shown in FIGS. 4 and 4A. A horizontal plate-like attachment 76, as shown in FIG. 4A, secures the abutted ends of the headrail components so that one continuous headrail is formed from the two identical component headrail parts.

Figure 5:
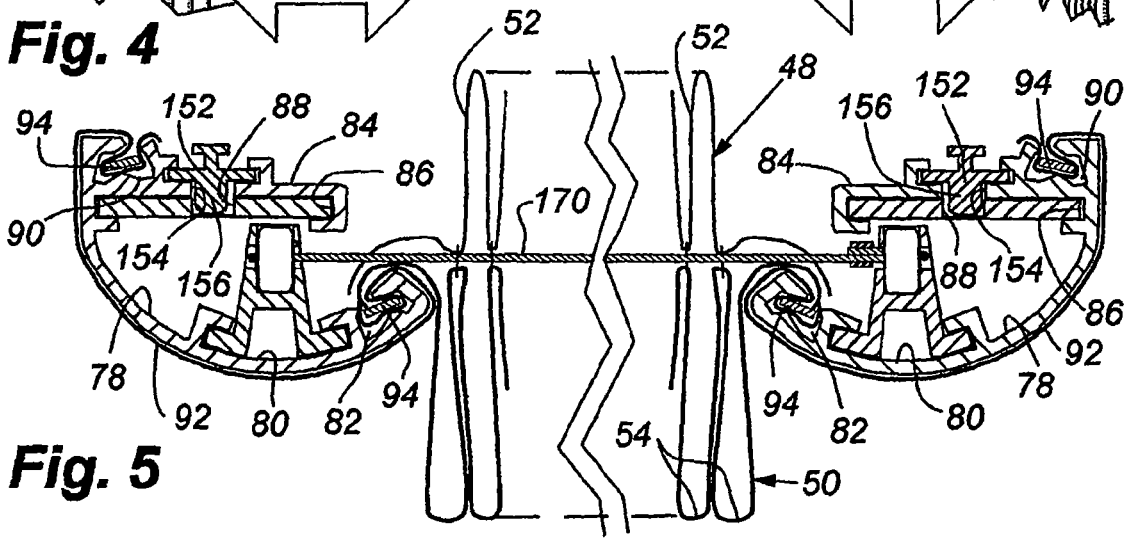
FIG. 5 is an enlarged fragmentary section taken along line 5-5 of FIG. 3.
Figure 17:
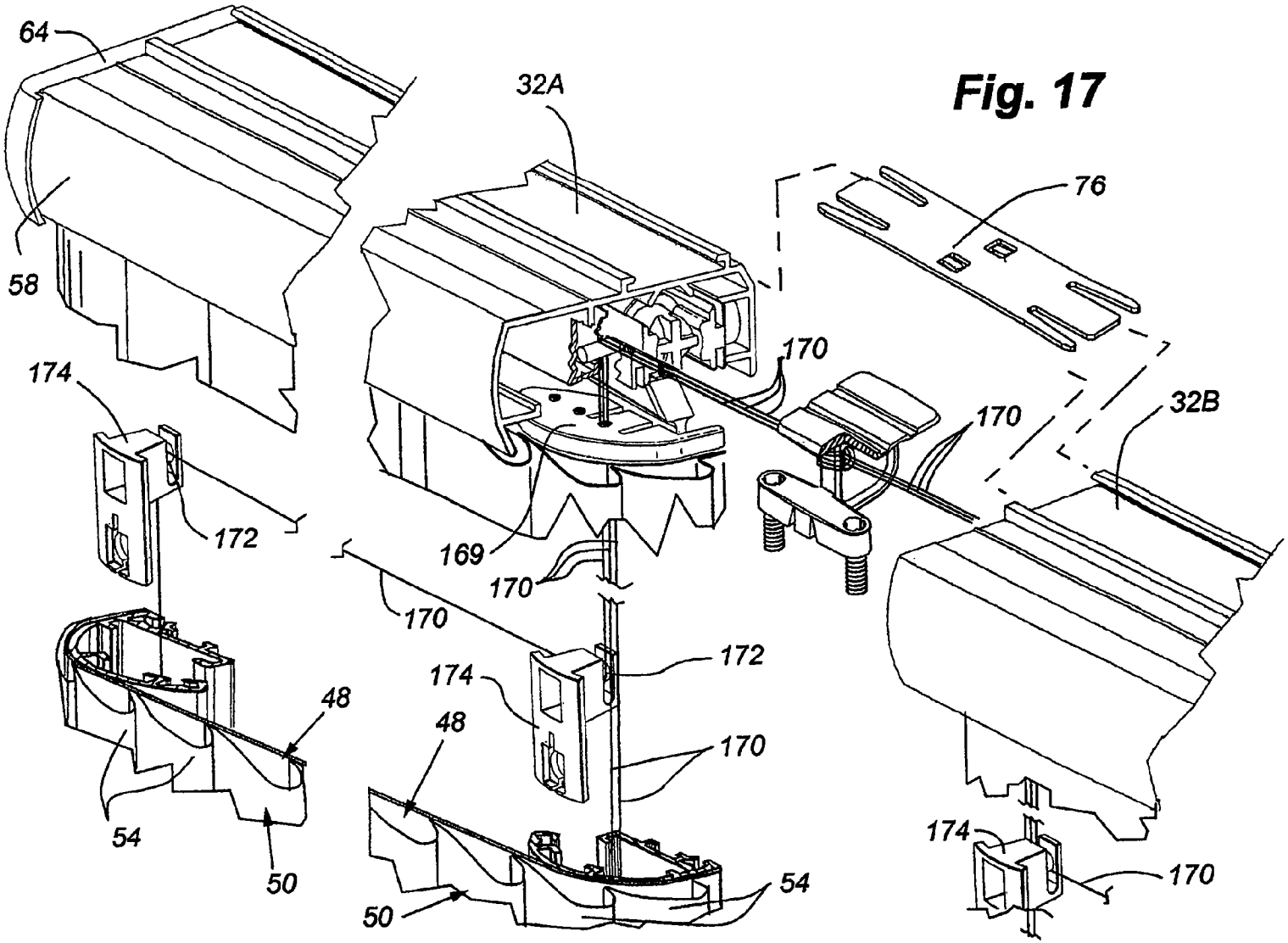
FIG. 17 is an exploded diagrammatic showing the headrail, the top ends of the fixed vertical rail and the movable vertical rail as well as the cord system for maintaining a parallel relationship between the fixed and movable vertical rails.
Figure 18:
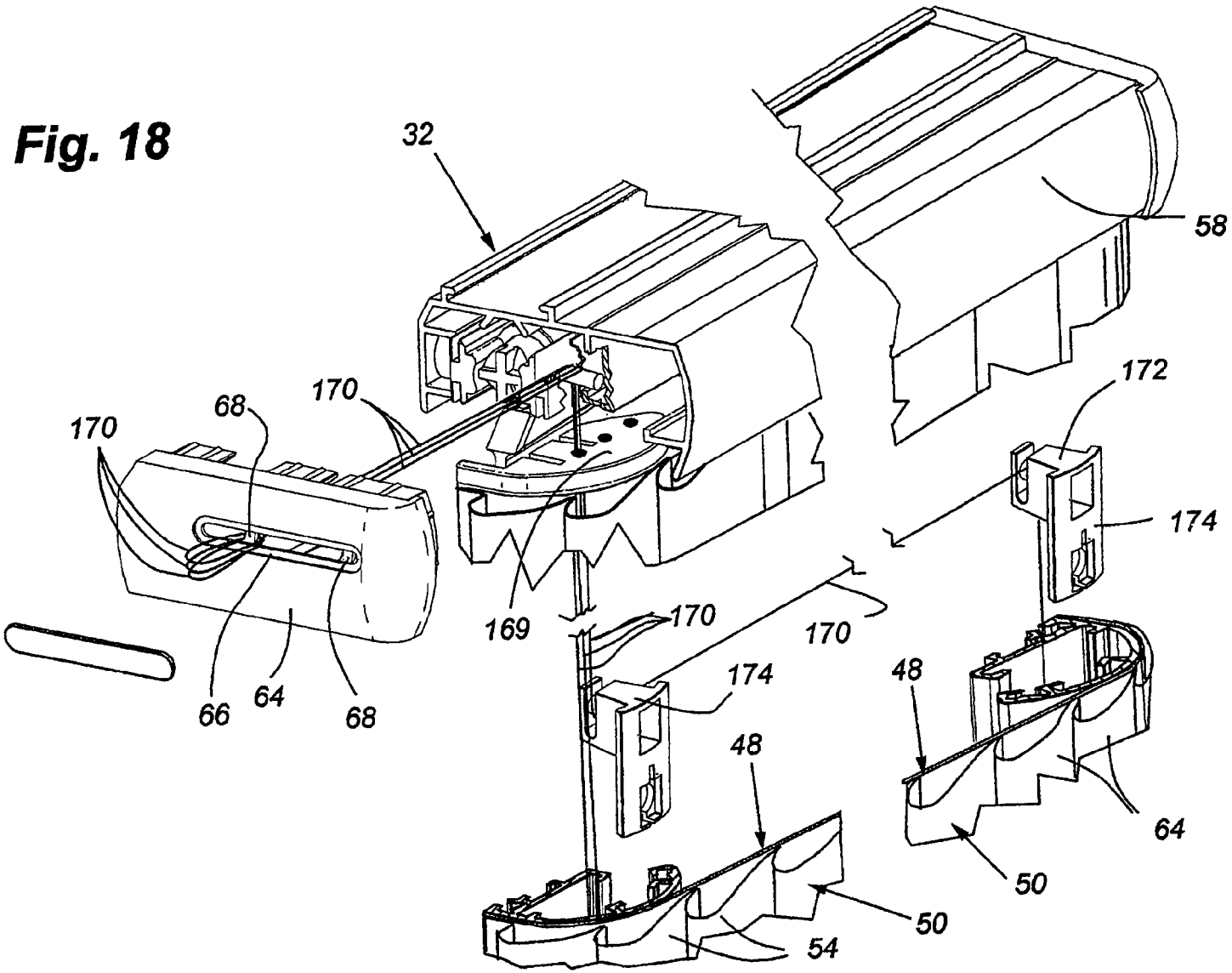
FIG. 18 is a fragmentary exploded isometric showing the connection of the headrail, the top ends of the fixed and movable vertical rails, and the cords at the movable end of the headrail.

The fixed 40 and movable 42 vertical rails as best seen in FIGS. 5,17 and 18, are identical in cross-section but mounted in mirror image to each other by inverting one of the rails. Each vertical rail can be seen probably best in FIG. 5 to include an arcuate front wall 78 having first 80 and second 82 channels formed on a rear surface thereof, and a generally flat rear wall 84 having a channel 86 formed on the front surface thereof and first 88 and second 90 channels formed on the rear surface thereof. The second channels 82 and 90 on the arcuate front wall and the flat rear wall are used to anchor a decorative cover 92 of fabric which might coordinate with the fabric of the retractable panel 34 with vertical edges of the decorative fabric cover being confined within the second channels of the rail with anchor strips 94 in a conventional manner. The second channel 82 on the arcuate front wall of the rail is also used to anchor one vertical edge of the front 50 and back 48 sheets of the collapsible panel again with the anchor strip 94 as is conventional and as can be seen in FIG. 5. The purpose for the first channel 80 on the arcuate front wall and the forwardly opening 86 and first 88 channel on the flat back wall of the rail will become clear with the description that follows.

Figure 6:
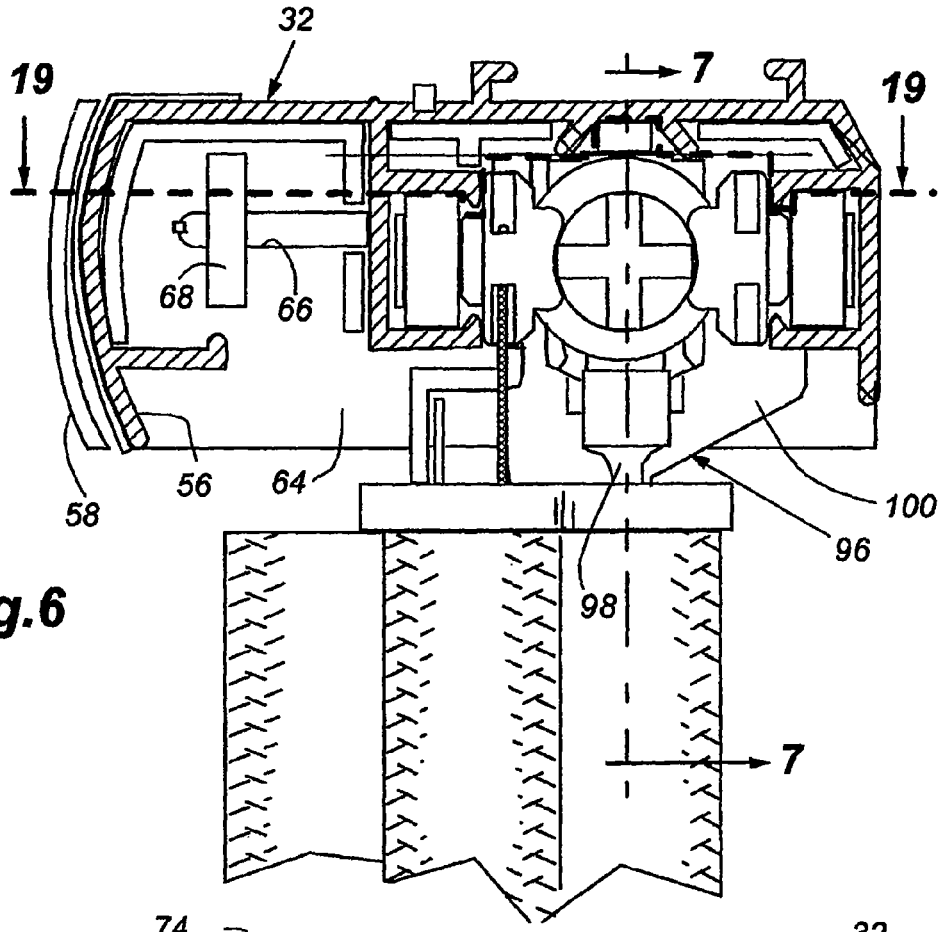
FIG. 6 is an enlarged fragmentary section taken along line 6-6 of FIG. 3.
Figure 19:
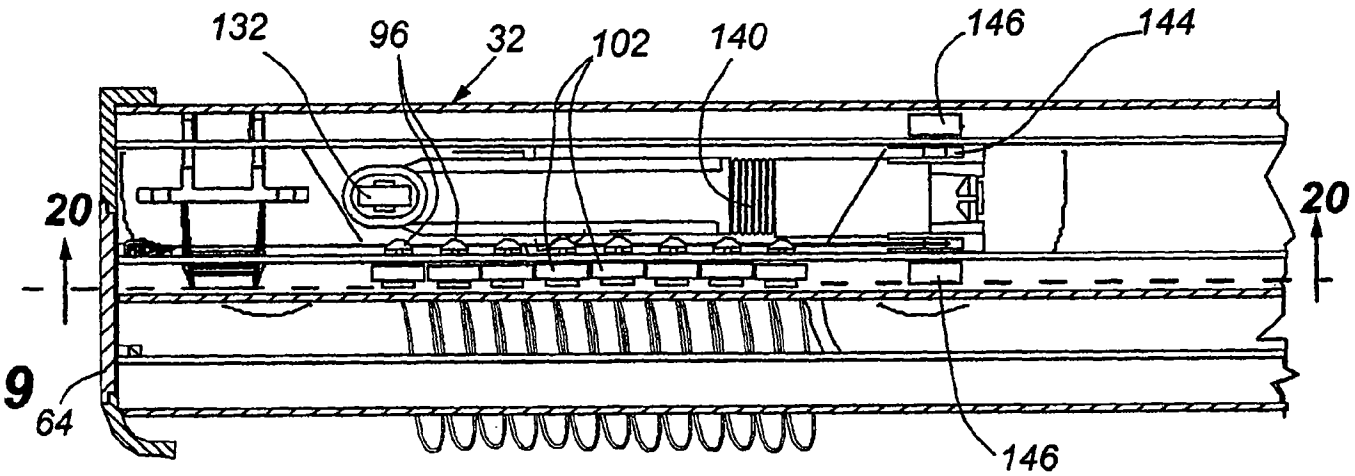
FIG. 19 is a section taken along line 19-19 of FIG. 6.
Figure 20:
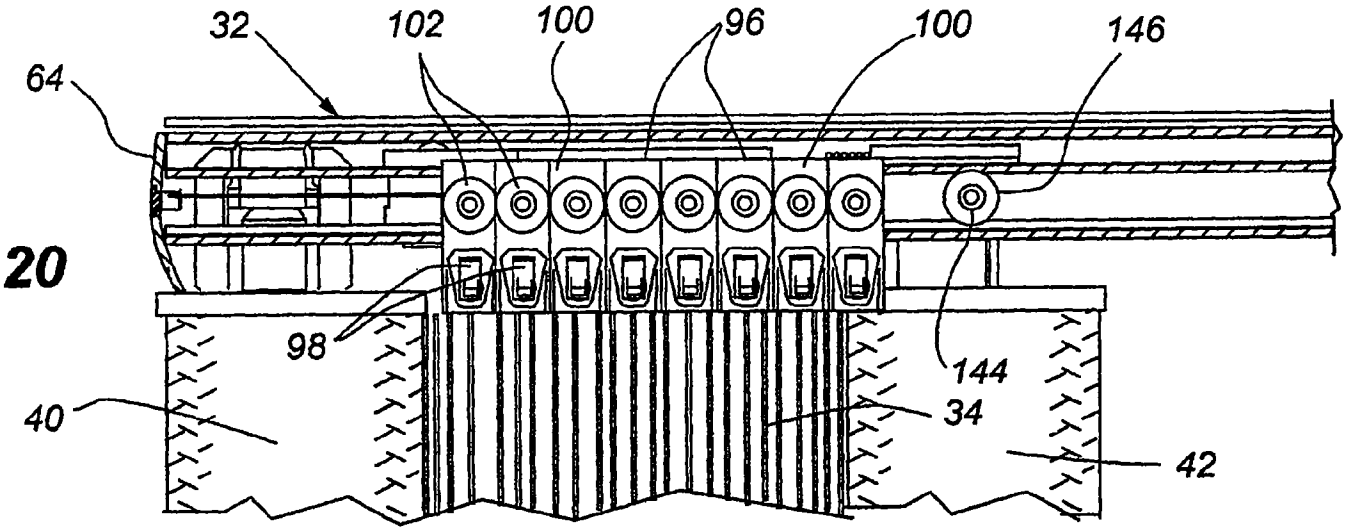
FIG. 20 is a front elevation looking at the headrail as shown in the horizontal section of FIG. 19.
Figure 21:
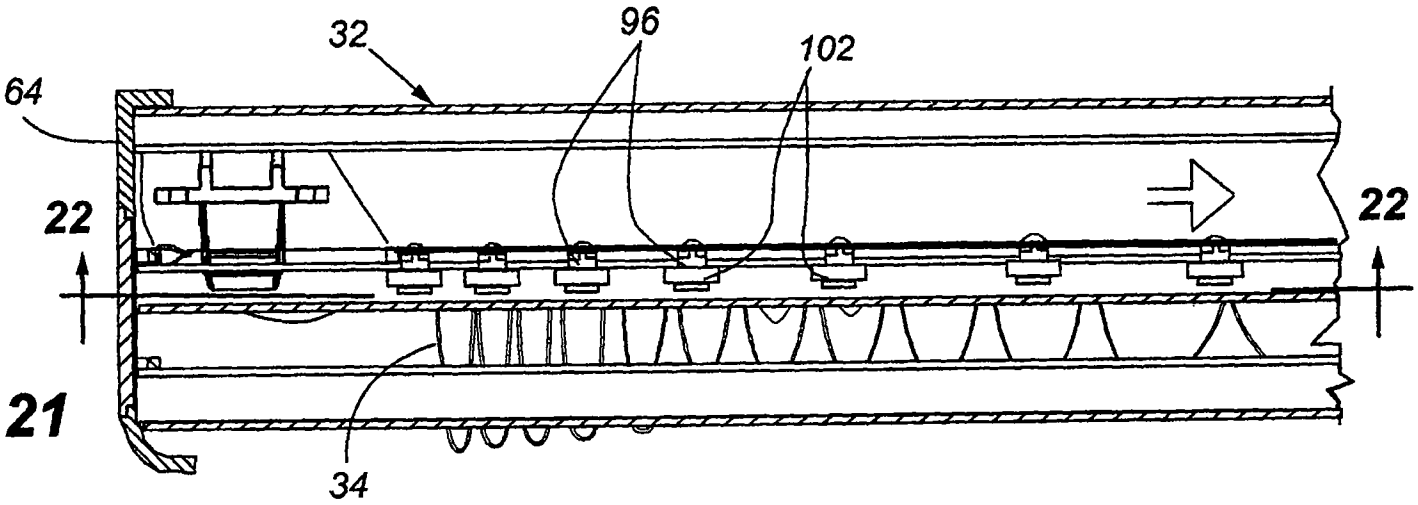
FIG. 21 is a section similar to FIG. 19 with the shade panel having been extended from its fully collapsed position in FIG. 19.
Figure 22:
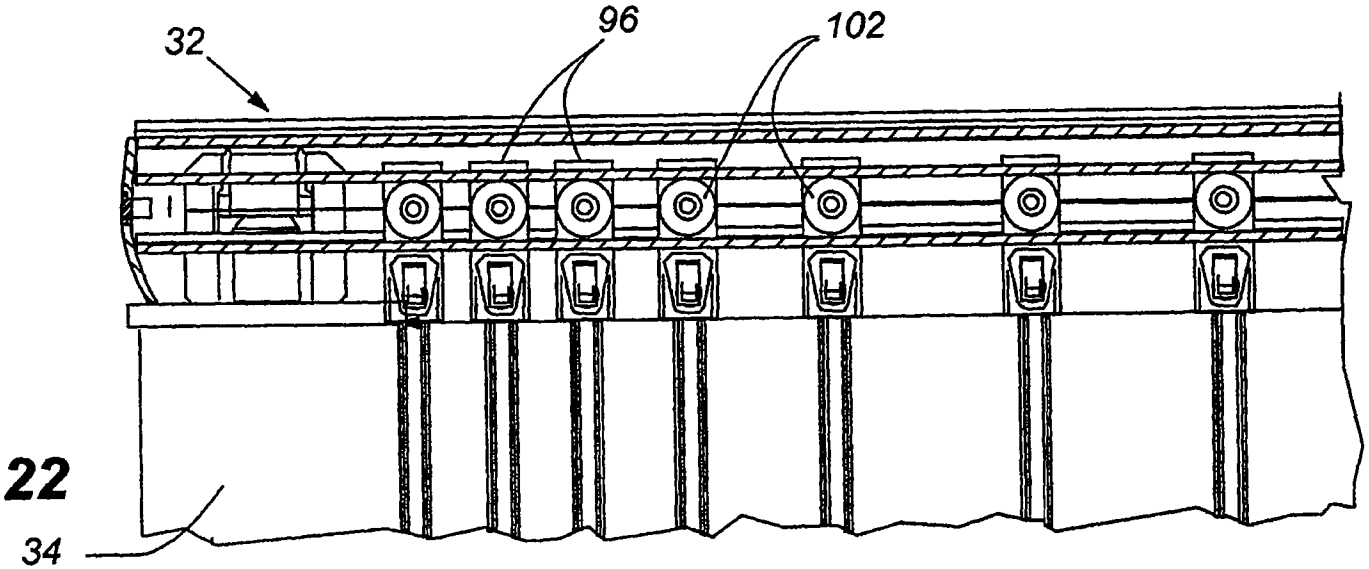
FIG. 22 is a section taken along line 22-22 of FIG. 21.

Substantially, conventional carriers 96 are used to support the collapsible panel 34 from the headrail 32 and are used in many vertical vane coverings for architectural openings. A detailed description therefor is not deemed necessary, but by referencing FIGS. 6, 19, and 20, it will be appreciated that a plurality of the carriers have clips 98 at a lower end that are attachable to a top edge of the collapsible panel, an upwardly extending arm 100, and rollers 102 carried on the upper end of the arm that rotate about horizontal axles. The rollers on the carriers ride within the inner side track 60 of the headrail 32 that is substantially positioned along the transverse center of the headrail. The carriers are uniformly spaced along the width of the collapsible panel so that the vertically-extending loops 52 formed on the panel are of uniform size and spacing.

The rollers for the carriers are different than conventional rollers in that they are made of an elastomeric material that has some resiliency but is firm enough to support the panel for smooth rolling movement along the length of the headrail. An elastomer manufactured under the name santoprene by Monsanto, Exxon Mobil, DuPont, as well as others, having an 80 shore A rating has been found desirable. The elastomeric rollers dampen the sound of the rollers as they traverse along the tracks in the headrail and further, since the rollers are elastomeric and therefore have some resiliency, they can be rocked into or out of the track for replacement if necessary. In other words, the elastomeric characteristic of the rollers allows them to be temporarily deformed for removal or insertion into the track. Accordingly, if one of the rollers were to break for some reason, it can be easily changed without having to remove all other carriers from the track.

As mentioned previously, the fixed vertical rail 40 is secured to a side frame member of the architectural opening in which the retractable covering is mounted, and the attachment can be made in numerous ways such as, for example, with a clip and suitable fasteners 104 as shown in FIGS. 1A and 1B. The relationship of the fixed rail to the headrail is uniformly obtained in a manner to be described hereafter.

Figure 10A:
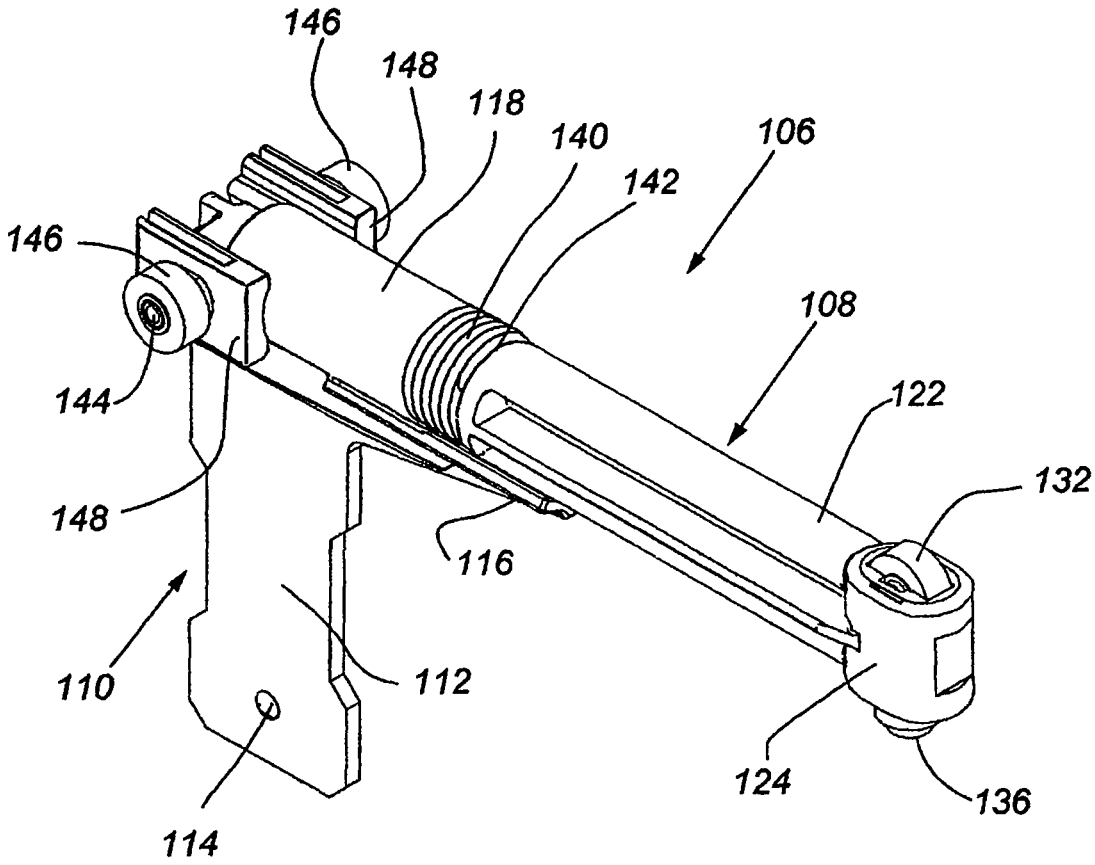
FIG. 10A is an isometric looking downwardly at the trolley used in the covering of the present invention.
Figure 10B:
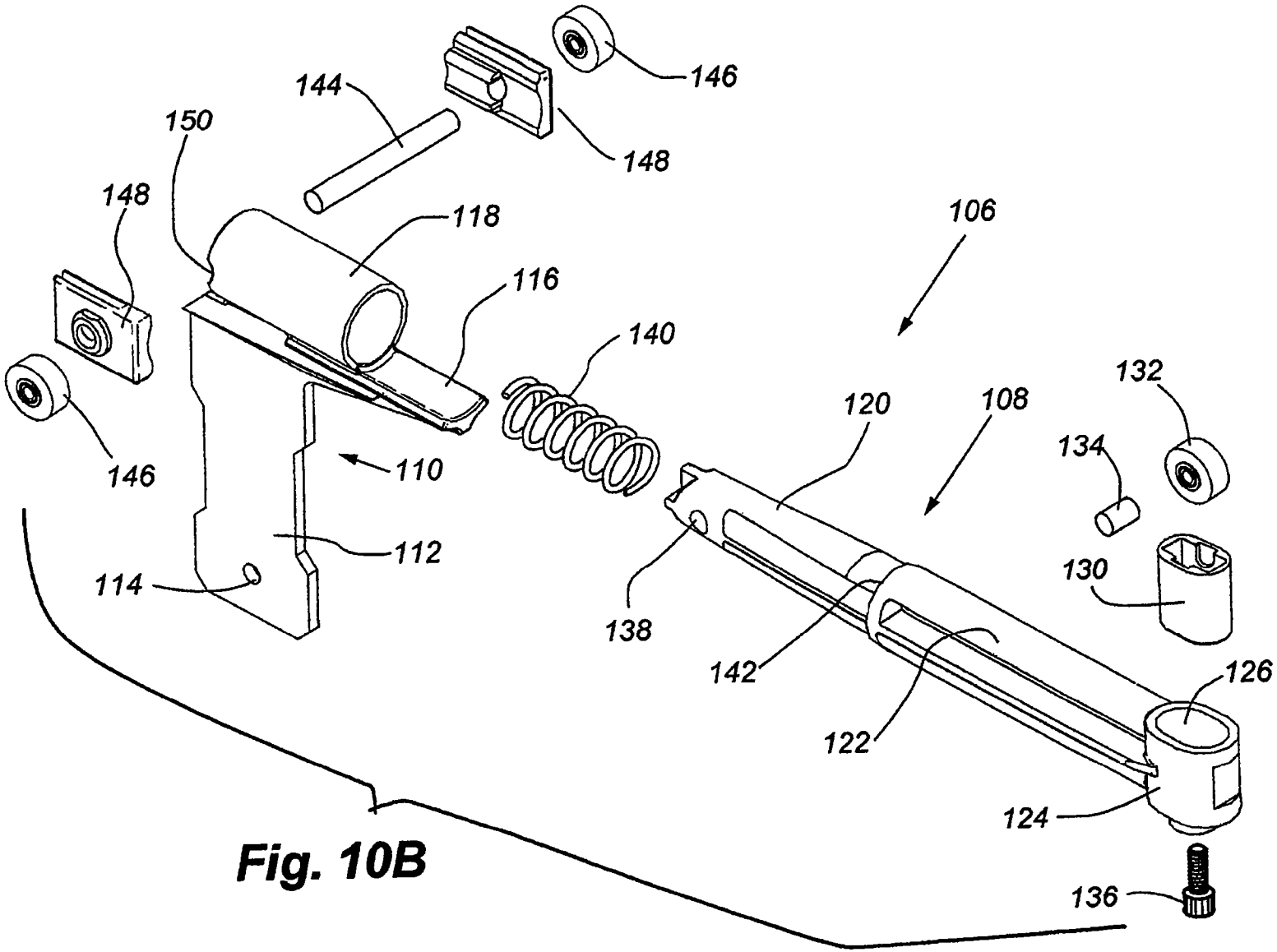
FIG. 10B is an exploded isometric of the trolley as shown in FIG. 10A.

The movable vertical rail 42 is supported from the headrail 32 with a trolley 106, probably seen best in FIGS. 10A and 10B. As will be appreciated from the description that follows, the trolley is universal in that it is usable with movable rails that are movable in either direction from a fixed rail. The trolley has a horizontal leg 108 and a vertical leg 110 depending from the proximal end of the horizontal leg. The vertical leg has a depending flat plate 112 with a transverse hole 114 adjacent to its lower end, and has on its upper end a horizontally extending support arm 116 with a hollow cylindrical sleeve 118 that is continuous with an upwardly concave support surface of the support arm. The horizontal leg is an elongated bar, and like the vertical leg is made of a rigid, strong, and preferably metallic material, having a proximal end 120 of generally cylindrical configuration that is slidably insertable through the cylindrical sleeve 118 of the vertical leg. An axial distal extension 122 from the proximal end 120 of the horizontal leg has a boss 124 formed at its distal end with an ovular recess 126 opening upwardly, and a threaded passage 128 opening downwardly while communicating with the recess. An ovular block 130 supporting a single or sole 132 roller about a horizontal shaft 134 is loosely seated in the ovular recess, and an adjustment screw 136 is threaded into the passage 128 so as to abut the bottom of the ovular block so that its vertical disposition within the ovular recess can be adjusted. The proximal end 120 of the horizontal leg has a horizontal transverse passage 138 and is of sufficient length to extend through the cylindrical sleeve 118 while accommodating a compression spring 140 between the cylindrical sleeve and an abutment shoulder 142 at the intersection of the proximal end 120 with the axial distal extension 122. When the horizontal leg has been fully inserted into the cylindrical sleeve so that the compression spring is substantially compressed, the transverse passage 138 in the proximal end of the horizontal leg is exposed at the proximal end of the vertical leg 110 so that a horizontal axle 144 can be inserted therethrough to hold the horizontal leg to the vertical leg of the trolley. The axle supports rollers 146 on opposite ends thereof and inwardly of the rollers, guide sleeves 148 to facilitate positioning of the trolley 106 in the open upper end of the movable rail 42.

It should also be noted that the proximal end of the cylindrical sleeve 118 has diametrically and horizontally aligned notches or detents 150 which releasably seat the axle 144. The axle is releasably held in the detents by the compression spring 140. The vertical leg 110 of the trolley 106 can be pivoted about the axis of the cylindrical sleeve removing the axle 144 from the detents by overcoming the bias of the compression spring if desired for a purpose to be described hereafter.

Figure 11C:
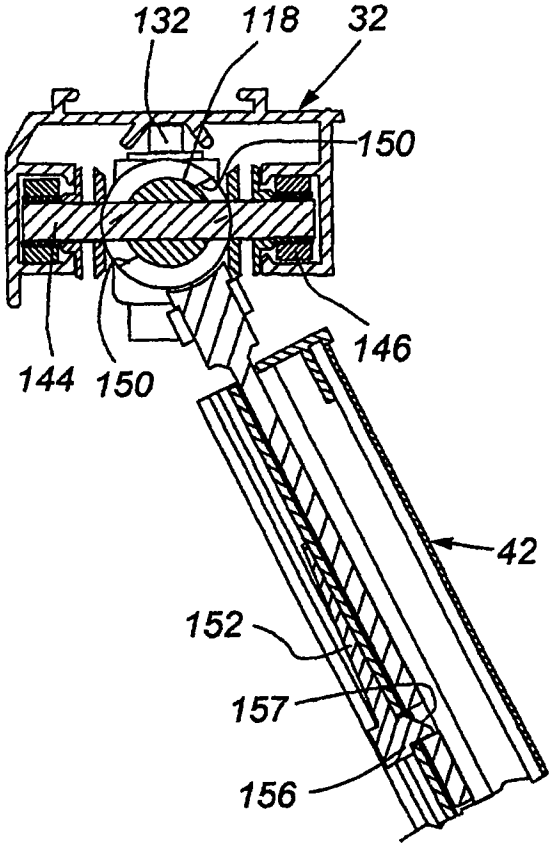
FIG. 11C is a section similar to FIG. 11A with the trolley and shade panel having been pivoted to the right.
Figure 11A:
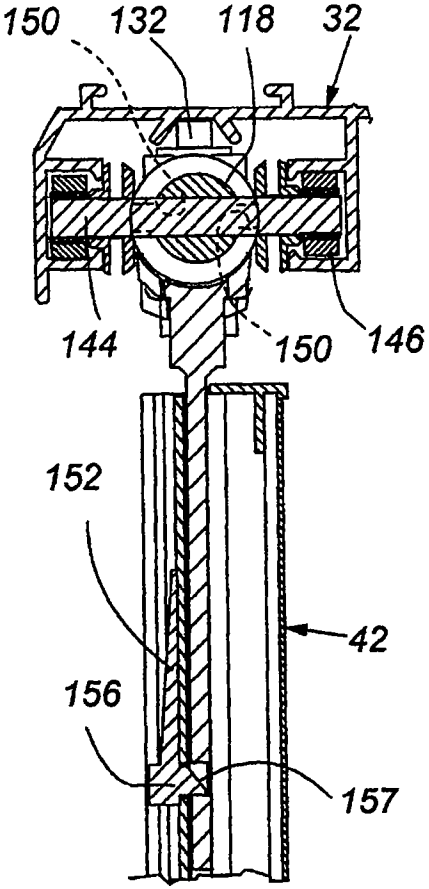
FIG. 11A is a fragmentary section taken along line 11A-11A of FIG. 7.
Figure 11B:
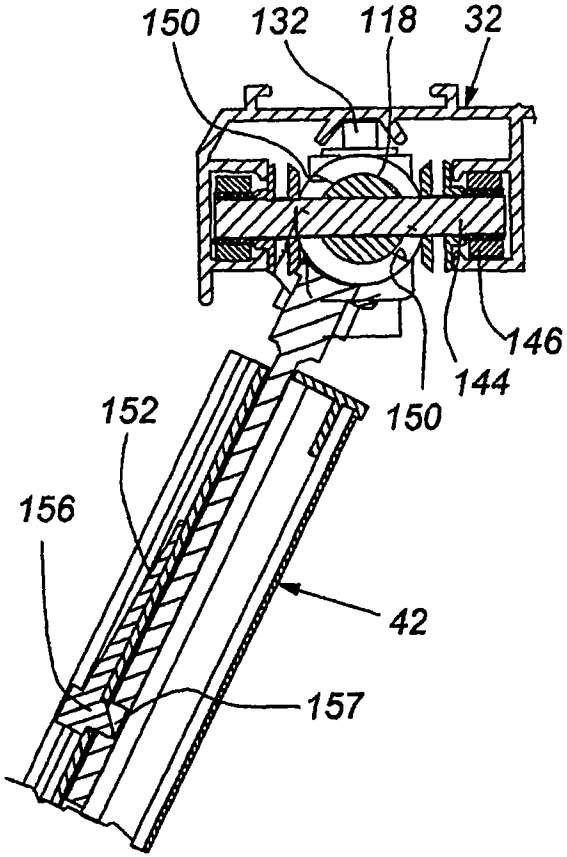
FIG. 11B is a section similar to FIG. 11A with the trolley and shade panel having been pivoted to the left.

The connection of the vertical leg 110 of the trolley 106 to the open upper end of the movable rail 42 is probably best appreciated by reference to FIGS. 5 and 11A-11C. It will there be seen the plate-like portion 112 of the vertical leg of the trolley is slidably received in the forwardly opening channel 86 of the flat rear wall of the movable rail. The plate-like portion of the vertical leg is retained in a fully-inserted position with a wedge-shaped clip 152, as best seen in FIGS. 11A-11C, which is slidably received in the first rearwardly opening channel 88 of the rear wall of the movable rail. The clip is made of a somewhat soft and resilient material but will substantially hold its shape when being inserted into the rail. The rear wall 84 of the movable rail has a passage 154 therethrough at a predetermined separation from the top end of the rail such that the passage is alignable with the hole 114 through the vertical leg of the trolley when the vertical leg is fully inserted into the open upper end of the movable rail. The wedge-shaped clip has a protrusion 156 that extends through the passage 154 in the rear wall of the movable rail and projects forwardly therefrom so that the lower end of the vertical leg of the trolley when being inserted into the open upper end of the movable rail will engage a cam surface 157 on the clip to force it rearwardly until the hole 114 through the vertical leg of the trolley is aligned therewith at which point the resilient material from which the clip is made will cause the protrusion to expand and extend into the transverse passage 154 to hold the vertical leg within the open upper end of the movable rail.

FIGS. 11A-11C illustrate how the movable rail 42 can be pivoted about the horizontal axis of the cylindrical sleeve 118 as when the covering is being operated. In other words, while it might be desirable to maintain the movable rail in a vertical orientation as it is slid along the length of the headrail, if the operator were to push or pull the movable rail perpendicularly to the plane of the panel 34 (FIGS. 11B and 11C) during operation, it would cause the vertical leg 110 of the trolley 106 to pivot and the axle 144 to snap out of the detents 150 permitting a limited amount of pivotal movement of the movable rail to avoid damage thereto. By repositioning the movable rail into the vertical orientation of FIG. 11A, it will releasably snap into position and thereby releasably maintain a vertical orientation of the rail as opposed to the pivoted positions illustrated, for example, in FIGS. 11B and 11C.

With reference to FIGS. 6-9, 11A-11C, 19 and 20, the relationship of the trolley 106 to the headrail 32 is best appreciated. It will there be seen that the pair of rollers 146 at the proximal end of the trolley are positioned within the confronting inner 60 and outer 62 side tracks of the headrail and are movable therealong. When the horizontal leg 108 of the trolley is disposed horizontally, the single roller 132 at the distal end of the horizontal leg is positioned within the upper track 70 of the headrail, and it is held therein with a stabilizing cord system to be described hereafter. Maintaining a horizontal disposition of the horizontal leg of the trolley of course maintains a vertical orientation of the vertical leg 110 of the trolley and thus the movable rail 42 in which the vertical leg of the trolley is inserted and retained.

As mentioned previously, the rollers 102 on the carriers 96 are also confined within the inner side track 60 of the headrail so that they roll in the same track as one of the pair of rollers 146 at the proximal end of the trolley 106. There is no interference between the identified roller of the pair of rollers 146 and the rollers 102 on the carriers within the track, however, until the rollers of the carriers are disposed along side the horizontal leg 108 of the trolley which, of course, allows the panel material 34 to be desirably accumulated along the length of the horizontal leg of the trolley similarly to its accumulation along the remainder of the headrail. This permits the panel fabric to be gathered in a uniform and aesthetically pleasing manner when the panel is retracted as the fabric material can gather along the length of the horizontal trolley leg in a uniform manner with its gathering along the remainder of the headrail.

Figure 8:
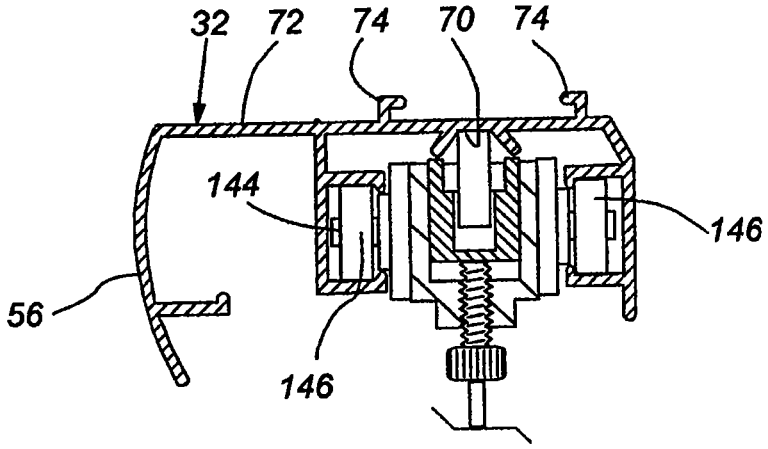
FIG. 8 is a section taken along line 8-8 of FIG. 7.
Figure 9:
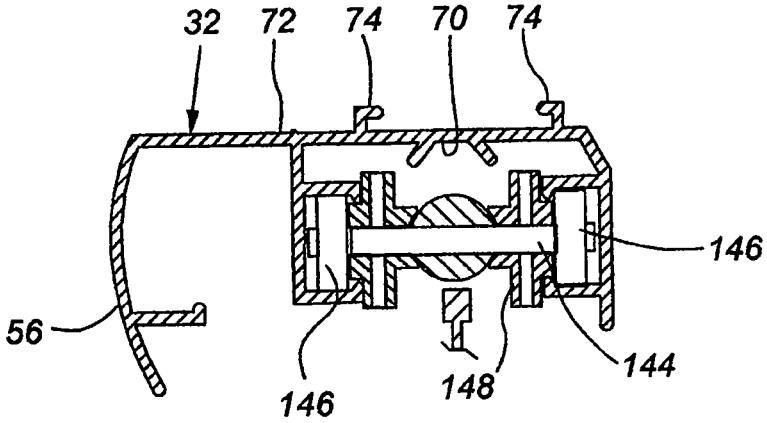
FIG. 9 is a section taken along line 9-9 of FIG. 7.

FIGS. 8 and 9 illustrate the relationship of the trolley 106 to the headrail 32 and it will there be clearly seen how the pair of rollers 146 are confined within the side tracks 60 and 62 of the headrail, and in FIG. 8 how the single roller 132 at the distal end of the trolley is confined within the upper track 70. As mentioned previously, the single roller is rotatably mounted in an ovular or non-circular block 130 so as to maintain desired alignment with the upper track of the headrail, and the threaded adjustment screw 136 can be advanced against the ovular block and thus the single roller against the top wall of the headrail 32 to assure a horizontal disposition of the horizontal leg 108 of the trolley.

As will be appreciated from the description thus far, however, the distal end of the horizontal leg 108 of the trolley 106 is not supported other than by the bias of gravity on the movable rail 42 which urges the movable rail and thus the vertical leg 110 of the trolley into a vertical disposition. It is desirable, however, to make sure that the movable rail is always vertically disposed which maintains a rolling engagement of the single roller 132 against the top wall of the headrail once the single roller has been desirably adjusted as mentioned above. The vertical orientation of the movable rail is achieved with the stabilizing cord system mentioned previously which assures that the movable rail remains parallel with the fixed rail 40 at all times. Of course, the fixed rail is vertically fixed in position through its attachment to a vertical frame member of the architectural opening.

Figure 12:
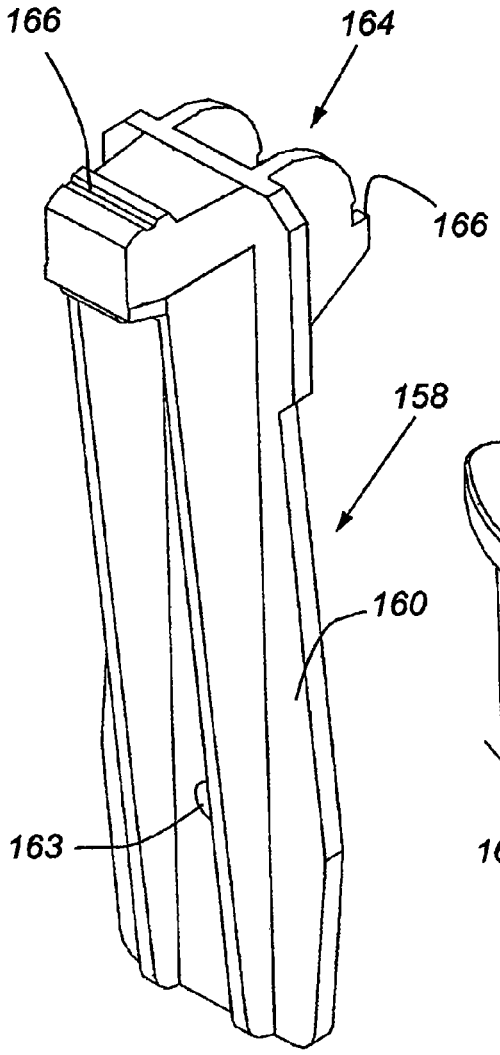
FIG. 12 is an isometric of an end plug for insertion into the top end of the fixed vertical rail of the covering.
Figure 13:
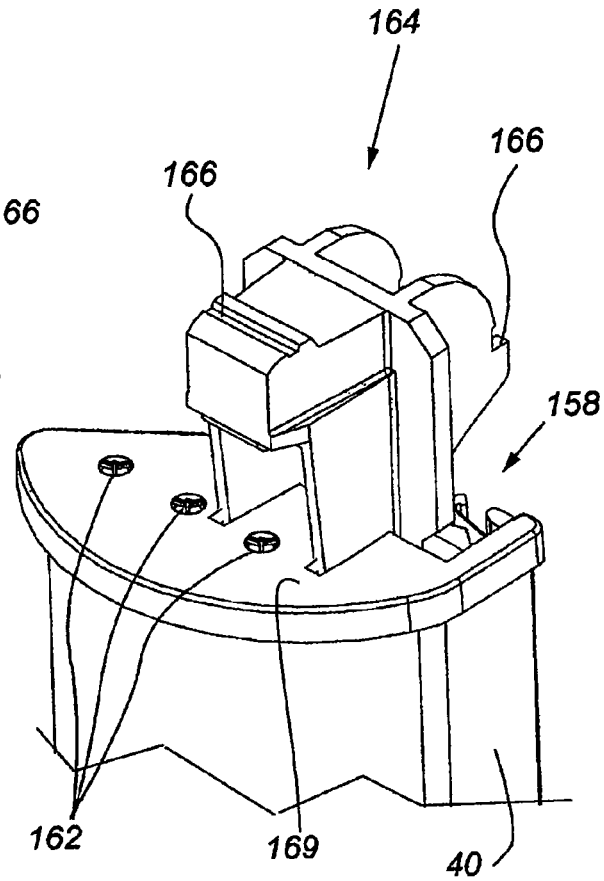
FIG. 13 is a fragmentary isometric showing the end plug of FIG. 12 received within the top end of a fixed vertical rail of the covering.
Figure 14:
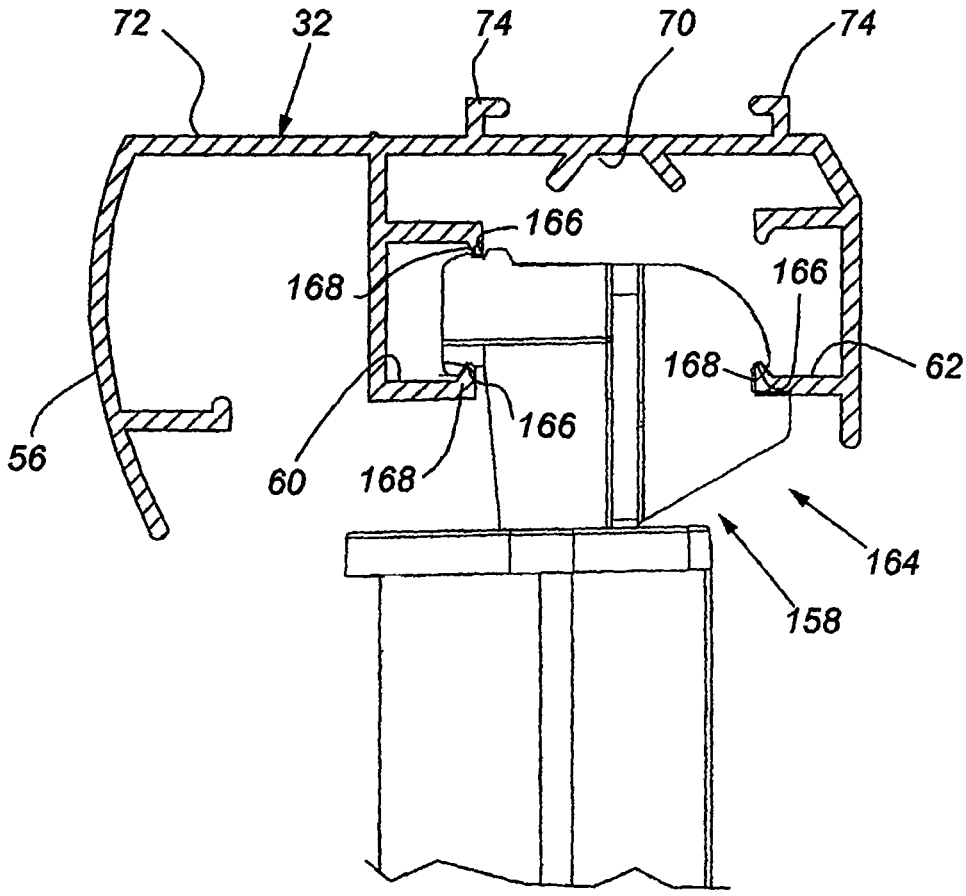
FIG. 14 is a transverse section through the headrail showing the end plug of FIG. 12 received in the fixed vertical rail and supported by the headrail.

It should be further noted before describing the stabilizing cord system that the fixed rail 40 is not only anchored to a side frame member of the architectural opening, but is suspended from the headrail 32 with an end plug 158 seen best in FIGS. 12-14 to assure a uniform relationship of the fixed rail with the headrail. The end plug has an elongated vertical body 160 with a transverse passage 162 therethrough, and the body is designed to be slidably inserted into the forwardly opening channel 86 on the rear wall 40 of the fixed rail as seen also in FIG. 5. Again, a wedge clip 152 identical to that previously described is used on the fixed rail in the same manner as it is used on the movable rail to secure the elongated body of the end plug in position and projecting upwardly from the top end of the fixed rail as seen in FIGS. 13 and 14. The end plug has an enlarged head 164 protruding upwardly from the upper end of the fixed rail with the head having grooves 166 defined therein adapted to cooperate with lips 168 defined by the side tracks 60 and 62 of the headrail so that the vertical relationship of the fixed rail to the headrail is always the same.

Figure 15A:
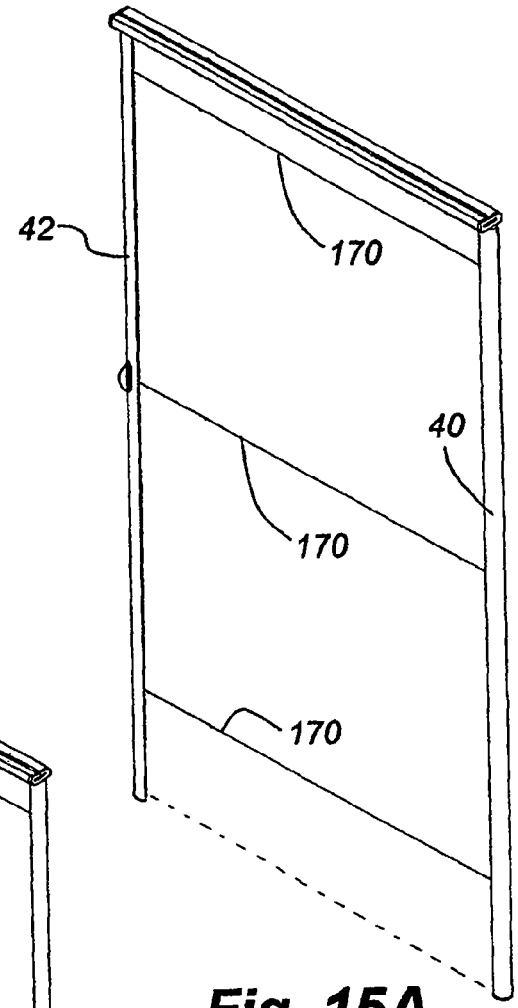
FIG. 15A is a diagrammatic isometric of a side-draw system in accordance with the invention with the shade panel having been removed so as to see the cord system for maintaining a parallel relationship between the fixed and movable vertical rails of the covering.
Figure 16A:
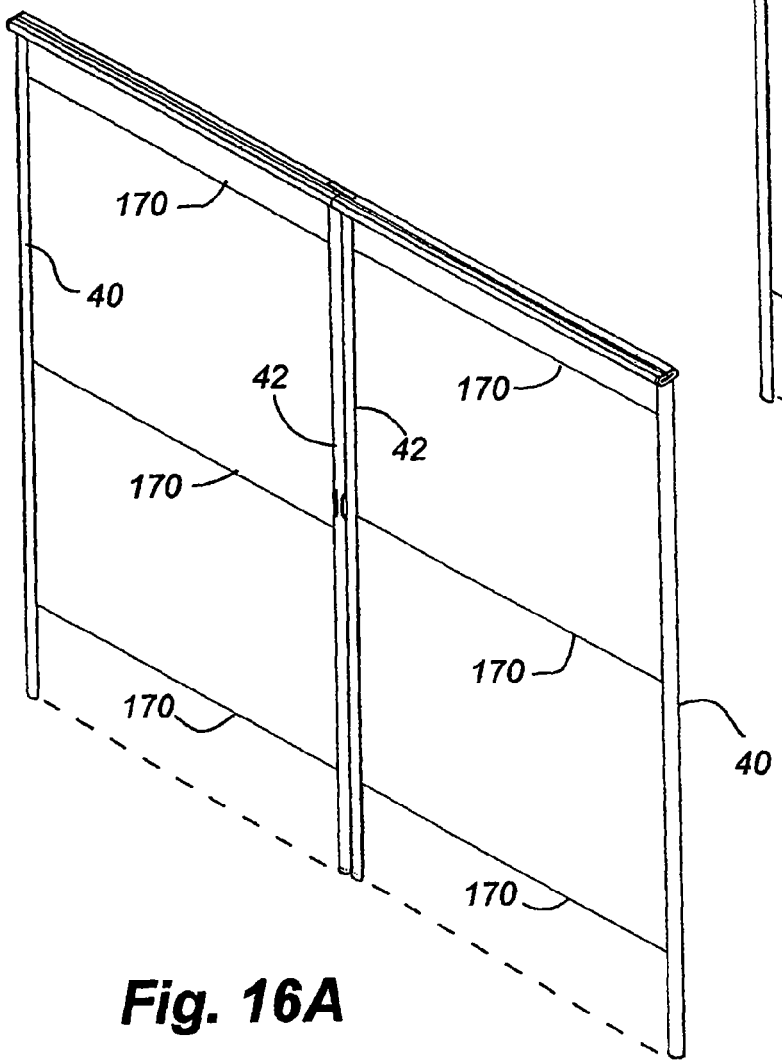
FIG. 16A is a diagrammatic isometric similar to FIG. 15A showing a center-draw system with the shade panel having been removed while illustrating the cord system for maintaining a parallel relationship between the fixed and movable vertical rails of the covering.
Figure 15B:
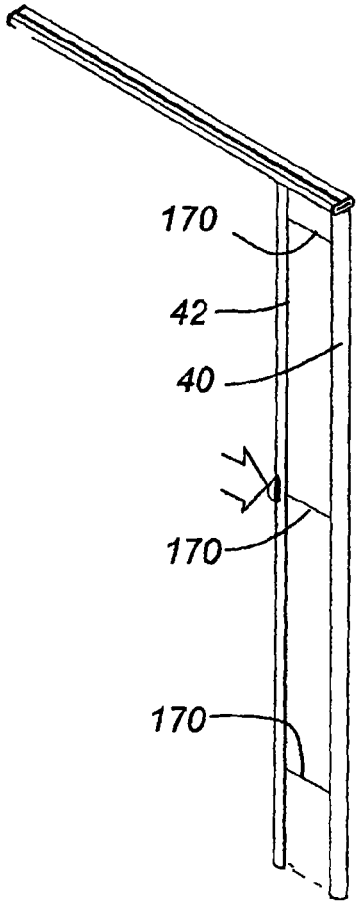
FIG. 15B is a diagrammatic view similar to FIG. 15A with the covering fully retracted.
Figure 16B:
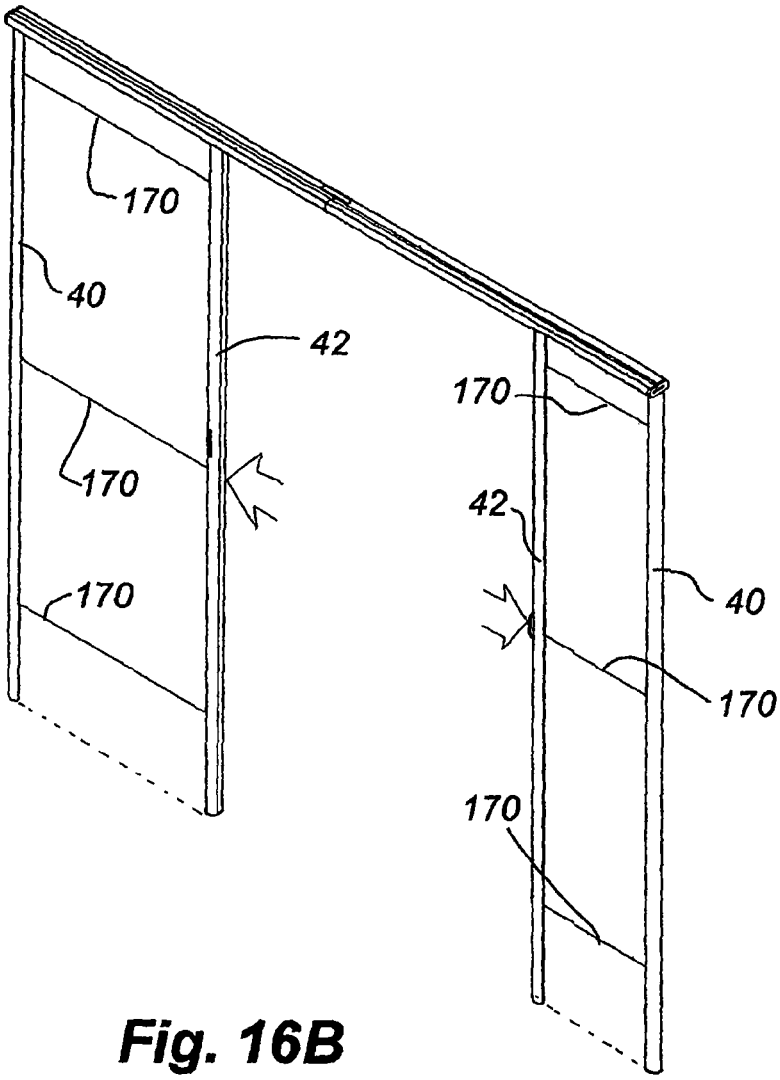
FIG. 16B is a diagrammatic isometric similar to FIG. 15B with the right panel fully retracted and the left panel partially retracted.

The stabilizing cord system is probably best appreciated by reference to FIGS. 15A-16B. FIGS. 15A and 15B show the stabilizing cord system for a side-draw system 44, while FIGS. 16A and 16B show the stabilizing cord system for a center-draw system 46. In the stabilizing cord system of the side-draw system, as seen in FIGS. 15A and 15B, and as will be explained in more detail hereafter, there are three non-extensible cords 170 which are anchored to the end cap 64 of the headrail at the opposite end of the headrail from the fixed rail 40. The cords are anchored to the end cap as illustrated in FIG. 18 by looping the cords around the vertically-extending ribs 68 and through the horizontal slot 66 described previously in the associated end cap. This connection firmly positions one end of each of three stabilizing cords. The three cords are extended horizontally along the headrail 32 and pass over the axle 144 for the pair of rollers 146 on the trolley 106 of the movable rail 42 where the three cords then extend downwardly through one of three holes 167 in an upper end cap 169 at the top of the movable rail and into the upper end of the movable rail. A first one of the three cords is then slidably extended around a pin 172 on an insert 174 positioned within the movable vertical rail, as will be described hereafter, and then extended horizontally through the shade panel 34 to a horizontally aligned pin 172 in an identical insert 174 positioned within the fixed rail 40. The cord is slidably passed around the pin 172 in the fixed rail and passed downwardly through the fixed vertical rail where it is anchored at the bottom of the fixed vertical rail. The second and third stabilizing cords are similarly routed around pins 172 in inserts 174 positioned at different elevations within the fixed and movable vertical rails and secured to the bottom of the fixed vertical rail. There are, therefore, three cords attached at the movable end of the headrail, i.e., the end of the headrail where the movable vertical rail is positioned in the extended position of the covering, and the cords extend downwardly through the movable vertical rail before extending horizontally to the fixed rail with each of the cords being at different elevations and secured to the fixed rail. As will be appreciated, this arrangement maintains a parallel relationship between the movable rail and the fixed rail which parallel relationship remains during sliding operation of the movable rail along the headrail inasmuch as the cords are of a fixed length.

Figure 23:
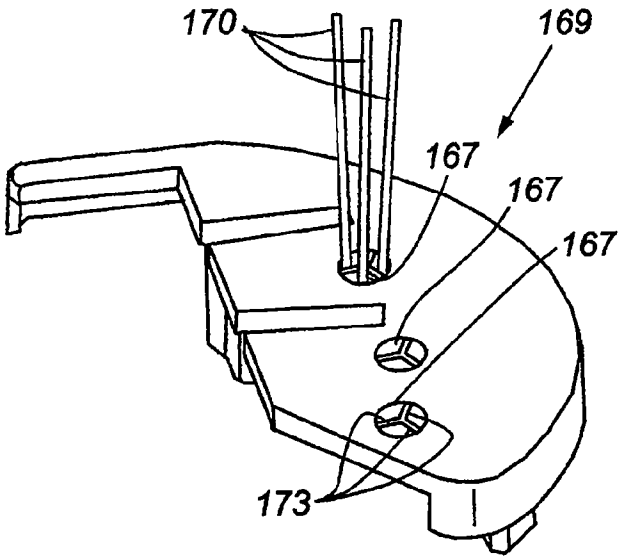
FIG. 23 is an isometric of a top end cap for the movable rail with the stabilizing cords extending therethrough.
Figure 24:
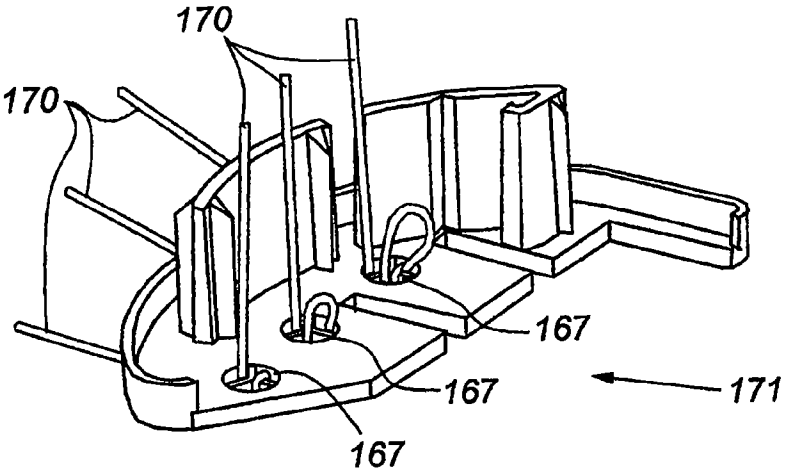
FIG. 24 is an isometric looking downwardly on a bottom end cap for the fixed rail with the stabilizing cords secured thereto.
Figure 25:
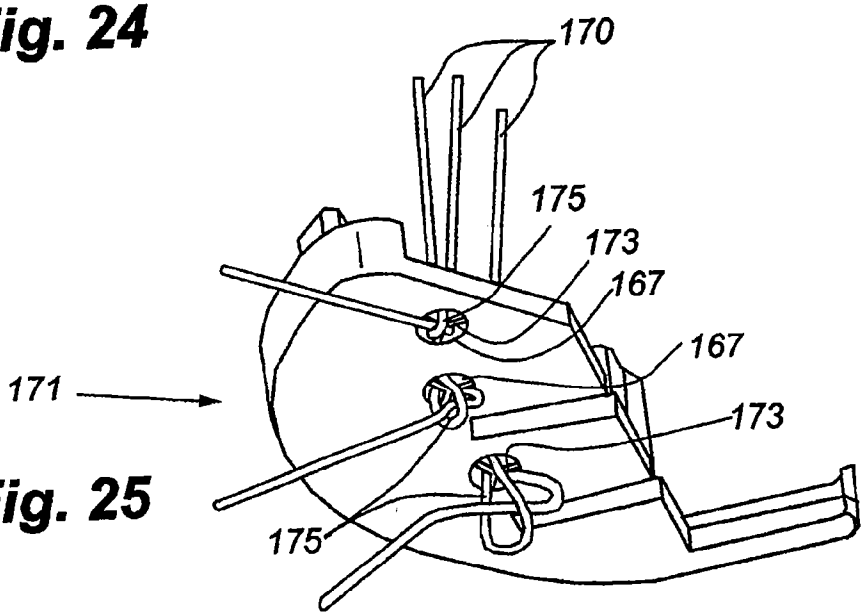
FIG. 25 is an isometric looking upwardly at the bottom end cap shown in FIG. 24.

A bottom end cap 171, as seen in FIGS. 24 and 25 at the lower end of the fixed end rail, is used to anchor each of the three stabilizing cords 170 to the lower end of the fixed vertical rail. The lower end cap of the fixed rail is identical to the upper end cap 169 of the movable vertical rail but is obviously inverted in configuration with each of the end caps having desirable ribbing 173 for frictional engagement with the contours of the rails to which they are attached to releasably retain the end caps in position. As mentioned previously, there are three holes passing through the end caps and each hole has star-shaped ribbing 173 formed therein to define three distinct hole passages. To prevent entanglement, the stabilizing cords entering the top end cap of the movable rail, as seen best in FIG. 23, are each extended through one of the passages in one of the holes so that the cords are somewhat aligned but retained separately from each other. When the cords reach the lower end of the fixed rail, each cord is extended through an associated or assigned one of the holes through the bottom end cap 171 and anchored to the ribbing 173 in that hole with slip knots 175 or the like as shown in FIGS. 24 and 25. In that manner, each of the three stabilizing cords can be pulled from the lower end of the fixed rail to remove any slack in the cord before it is secured to the bottom end cap 171 of the fixed vertical rail. Removal of all slack in the three stabilizing cords, of course, maintains the parallel and vertical relationship between the fixed and movable vertical rails regardless of their horizontal separation from each other as occurs during extension and retraction of the covering.

Of course, maintaining the parallel relationship between the movable rail 42 and the fixed rail 40 assures a vertical orientation of the movable rail and thus the vertical leg 110 of the trolley 106 which retains the horizontal leg 108 of the trolley in a horizontal orientation with the single roller 132 positively engaged within the upper track 70 on the lower surface of the top wall of the headrail 32.

The inserts 174, as possibly best seen in FIGS. 5, 17 and 18, are slidably inserted into the first rearwardly opening channel 80 on the front wall 78 of the rails 40 and 42 with each insert having a pin 172 around which the cord can slide. The inserts themselves are anchored at a desired elevation for each cord in any suitable manner.

Referring to FIGS. 16A and 16B, as well as FIG. 17, the stabilizing cord system for a center-draw system 46 is illustrated. It will there be seen that again there are three cords 170 associated with each movable panel 34, and as appreciated in FIG. 17, the three cords for each panel are anchored to a center clip 176 that is secured to the attachment plate 76 for the headrail 32 described previously. The clip can also be secured to the headrail with threaded fasteners. The three cords 170 associated with each movable panel 34 therefore extend toward and into an associated component 32A or 32B of the headrail where they pass around the axle 144 for the pair of rollers 146 on the associated trolley 106 and downwardly to a selected one of three pair of associated inserts 174 at different elevations within the associated movable and fixed rails for the panel.

Accordingly, in the center-draw system 46, the movable rails 42 are again retained in parallel relationship with the associated fixed rails 40 so that the horizontal legs 108 of the associated trolleys 106 are also maintained in a horizontal orientation with their single roller 132 positively engaged in the upper track 70 of the headrail.

It will be appreciated from the above that a retractable covering for an architectural opening has been described wherein fixed and movable rails along opposite side edges of a collapsible panel are retained in a parallel relationship, while a trolley connecting the movable rail to the headrail is retained in a desired relationship to assure smooth gliding movement of the movable rail along the headrail between extended and retracted positions of the covering. It should also be appreciated that the use of a single roller at the distal end of the horizontal leg of the trolley engageable in a single track separate from a track utilized by the carriers for supporting the panel enables the carriers to stack along the length of the horizontal leg of the trolley to permit uniform gathering of the panel along its full width including the portion of the panel that overlies the horizontal leg of the trolley.

Although the present invention has been described with a certain degree of particularity, it is understood the disclosure has been made by way of example, and changes in detail or structure may be made without departing from the spirit of the invention as defined in the appended claims.

What is claimed is:

1. A retractable covering movable between extended and retracted positions comprising in combination:

an elongated horizontal headrail defining front and rear horizontally aligned tracks and an upper track between and elevated from said front and rear tracks, a horizontally collapsible panel suspended from said headrail by a plurality of carriers adapted for movement along the length of said headrail when moving the covering between extended and retracted positions, a fixed vertical rail along one vertical edge of the panel and a movable vertical rail along an opposite vertical edge of the panel, and a trolley connecting the top of the movable rail to the headrail for translating movement along the headrail, said trolley including a pair of horizontally separated rollers at one end and a single roller between and elevated relative to said pair of rollers and rotational about a horizontal axis, said pair of rollers being positioned in and guided along said front and rear tracks and said single roller being positioned in and guided along said upper track during movement of said panel between extended and retracted positions.

2. The covering of claim 1 wherein said trolley further includes a vertical leg secured to said movable rail, said vertical leg being pivotal about a horizontal axis to permit said movable leg to pivot within a vertical plane.

3. The covering of claim 2 wherein said vertical leg is mounted within said trolley so as to be yieldingly but releasably retained in a vertical orientation.

4. The covering of claim 3 wherein said trolley further includes a horizontal leg on which all of said rollers are mounted.

5. The covering of claim 4 wherein said vertical leg is mounted on said horizontal leg for pivotal movement about said horizontal axis.

6. The covering of claim 1 wherein said single roller is adjustably mounted on said trolley.

7. The covering of claim 4 wherein said yielding but releasable mounting of said vertical leg includes a spring operably interconnecting said vertical and horizontal legs.

8. The cover of claim 1 or 7 wherein said fixed vertical rail is connected to one end of said headrail and said headrail includes an opposite end and wherein said covering further includes a stabilizing cord system for retaining said fixed and movable rails in parallel planes, said cord system including a plurality of non-extensible cords secured at one end to said opposite end of said headrail and extending along said headrail to said trolley where they then extend downwardly into said movable rail before slidably extending transversely and horizontally out of said movable rail at different elevations toward said fixed rail to which they are anchored.

9. The covering of claim 5 wherein said vertical leg includes a cylindrical sleeve that receives a proximal end of said horizontal leg.

10. A retractable covering movable between extended and retracted positions comprising in combination:

an elongated horizontal headrail defining front and rear horizontally aligned tracks and an upper track between and elevated from said front and rear tracks, a horizontally collapsible panel suspended from said headrail by a plurality of carriers adapted for movement along the length of said headrail when moving the panel between extended and retracted positions, a fixed vertical rail along one vertical edge of the panel and a movable vertical rail along an opposite vertical edge of the panel, and a trolley connecting the top of the movable rail to the headrail for translating movement along the headrail, said trolley including a pair of horizontally separated rollers at one end mounted on a common horizontal shaft and a depending leg for attachment to the movable rail for unitary movement therewith, said leg being pivotally mounted for pivotal movement about a longitudinal horizontal axis of the trolley, said trolley having a detent therein for releasable receipt of said shaft to releasably retain said leg in a vertical orientation while permitting said leg to be selectively pivoted about said axis with said movable rail.

11. The covering of claim 10, wherein said trolley further includes a single roller spaced longitudinally from and laterally between said pair of horizontally separated rollers.

12. The covering of claim 11, wherein said single roller is vertically adjustable relative to said longitudinal axis of said trolley.

13. The covering of claim 10, wherein said trolley further includes a spring configured to releasably hold said shaft in said detent.

14. The covering of claim 11 further comprising a spring positioned around said proximal end of said horizontal leg between said cylindrical sleeve and a shoulder separating said proximal end of said horizontal leg from a distal end of said horizontal leg.

* * * * *